US012716698B2

(12) United States Patent
Suty

(10) Patent No.: US 12,716,698 B2
(45) Date of Patent: Aug. 25, 2026

(54) TARGET SHOOTING, GAMING, AND DATA ACQUISITION SYSTEMS, AND ASSOCIATED DEVICES AND METHODS

(71) Applicant: Nosler, Inc., Bend, OR (US)

(72) Inventor: Grant Anton Suty, Bend, OR (US)

(73) Assignee: Nosler, Inc., Bend, OR (US)

( * ) Notice: Subject to any disclaimer, the term of this patent is extended or adjusted under 35 U.S.C. 154(b) by 0 days.

(21) Appl. No.: 19/174,600

(22) Filed: Apr. 9, 2025

(65) Prior Publication Data

US 2025/0321085 A1 Oct. 16, 2025

Related U.S. Application Data

(60) Provisional application No. 63/632,913, filed on Apr. 11, 2024.

(51) Int. Cl.

| | |
|---|---|
| ***F41J 5/14*** | (2006.01) |
| ***F41J 5/06*** | (2006.01) |
| *F41J 5/24* | (2006.01) |

(52) U.S. Cl.

CPC . *F41J 5/14* (2013.01); *F41J 5/06* (2013.01); *F41J 5/24* (2013.01)

(58) Field of Classification Search

CPC ..... F41J 5/14; F41J 5/06; F41J 5/24
USPC ..... 273/317–412
See application file for complete search history.

(56) References Cited

U.S. PATENT DOCUMENTS

| | | | | |
|---|---|---|---|---|
| 9,360,283 | B1 | 6/2016 | Tejada et al. | |
| 11,536,544 | B1 * | 12/2022 | Allen | H04R 3/005 |
| 2004/0087378 | A1 * | 5/2004 | Liu | F41A 33/02 463/53 |
| 2004/0205194 | A1 * | 10/2004 | Sahai | G06Q 20/4014 709/228 |
| 2011/0042900 | A1 * | 2/2011 | Hutchinson | F41J 2/02 273/381 |
| 2012/0258432 | A1 * | 10/2012 | Weissler | F41J 5/10 434/20 |

(Continued)

OTHER PUBLICATIONS

International Search Report and Written Opinion received for counterpart International Patent Application No. PCT/US2025/023924, mailed Jun. 9, 2025 (18 pages).

*Primary Examiner* — Peter S Vasat
*Assistant Examiner* — Stephen Alvesteffer
(74) *Attorney, Agent, or Firm* — Schwabe, Williamson & Wyatt, P.C.

(57) ABSTRACT

Target shooting, gaming, and data acquisition systems (and associated devices and methods) are disclosed herein. In one embodiment, a target shooting system includes (i) a target unit deployable at a first location at or near a location of a target, and (ii) a base unit deployable at a second location different from the first location. The target unit and the base unit can be configured to communicate with one another over a communication link. The target unit can further be configured to (a) detect projectile hits on the target and (b) communicate data relating to the projectile hits to the base unit via the communication link. The base unit can further be configured to communicate commands to the target unit via the communication link. The commands can include commands for proactively and/or reactively controlling the target unit, such as one or more visual indicators of the target unit.

20 Claims, 5 Drawing Sheets

(56) References Cited

U.S. PATENT DOCUMENTS

| | | | | |
|---|---|---|---|---|
| 2015/0084281 | A1* | 3/2015 | Miller | F41J 5/06 273/371 |
| 2015/0097338 | A1* | 4/2015 | Abramson | F41J 5/14 273/405 |
| 2016/0033240 | A1 | 2/2016 | Graham et al. | |
| 2016/0091285 | A1* | 3/2016 | Mason | F41J 5/14 273/372 |
| 2016/0195369 | A1* | 7/2016 | Perry | F41J 7/04 273/386 |
| 2017/0146324 | A1* | 5/2017 | Mcfadyen | F41J 5/18 |
| 2018/0202774 | A1* | 7/2018 | Sitzman | F41J 5/02 |
| 2019/0063882 | A1* | 2/2019 | Brockel | F41J 7/06 |
| 2021/0072002 | A1* | 3/2021 | Yockey | H04W 88/02 |
| 2021/0154557 | A1* | 5/2021 | Loudermilk, Jr. | A63B 71/0619 |
| 2022/0236038 | A1* | 7/2022 | Gill | F41J 5/14 |
| 2024/0377167 | A1* | 11/2024 | Baddeley | F41A 33/00 |
| 2025/0205574 | A1* | 6/2025 | Dolgin-Gardner | A63B 71/0622 |

* cited by examiner

TARGET SHOOTING, GAMING, AND DATA ACQUISITION SYSTEMS, AND ASSOCIATED DEVICES AND METHODS

CROSS-REFERENCE TO RELATED APPLICATION

The application claims the benefit of U.S. Provisional Patent Application No. 63/632,913, filed on Apr. 11, 2024, titled "TARGET SHOOTING, GAMING, AND DATA ACQUISITION SYSTEMS, AND ASSOCIATED DEVICES AND METHODS," which is incorporated herein by reference in its entirety.

TECHNICAL FIELD

The present disclosure relates generally to target shooting. For example, several embodiments of the present disclosure are directed to target shooting, gaming, and data acquisition systems (e.g., for recreational or competitive shooting sports, for sighting in a firearm, for firearm training, etc.), and to associated devices and methods.

BACKGROUND

Target shooting is the recreational or competitive use of a firearm, bow, air gun, slingshot, or other device to shoot projectiles at targets. The targets can be stationary or moving. For example, stationary targets are often used for pistol, rifle, air gun, archery, and other shooting sports. As another example, limited-motion targets (e.g., drop turner targets, swinging targets, clamshell targets, pop-up targets) are often used in competitive shooting events or scenario-based range/training courses. Such stationary or limited-motion targets can be made of paper, steel, rubber, and/or another suitable material, and may be freestanding or mounted on/affixed to other equipment (e.g., stands, cables) or backstops (e.g., metal plates, wood, cardboard, ballistics gel). As still another example, in trap or skeet shooting, participants use shotguns to shoot clay targets that are moving through the air.

Stationary and limited-motion targets are typically set up at one or more distances from a shooter that are appropriate for the equipment used by the shooter. For example, when using handguns, targets are usually set up at one or more distances between approximately 2 yards (1.83 meters) and approximately 25 yards (22.86 meters) from the shooter. As another example, when using bows, targets are commonly set up at one or more distances between approximately 10 yards (9.14 meters) and approximately 100 yards (91.44 meters). As still another example, when using rifles, targets are often set up at one or more distances between approximately 10 yards (9.14 meters) and approximately 300 yards (274.32 meters), or more.

Target shooting routinely involves tests of accuracy, precision, and/or speed. For example, target shooting often involves testing the accuracy of a firearm or other shooting device in combination with sights (e.g., a scope, a laser sight, iron sights, etc.) mounted thereon. As a specific example, when using a rifle, target shooting can include "sighting-in" the rifle, which is a process that includes setting up a target at a known distance (e.g., 100 yards or 91.44 meters) and adjusting a scope or other sights mounted on the rifle until the rifle can be used to routinely hit a bullseyes (or another desired spot) on the target within acceptable tolerances.

As another example, target shooting can involve testing the proficiency of one or more shooters, such as in individual and/or team competitions. In such settings, one or more targets can be set up at various shooting distances, and performance of the shooter(s) can be scored or gauged based on a variety of factors, such as accuracy (e.g., number of target strikes), precision (e.g., distance from a target strike to a bullseye or other spot on the target), and/or speed (e.g., time required to complete a course including one or more targets).

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure. The drawings should not be taken to limit the disclosure to the specific embodiments depicted, but are for explanation and understanding only.

DETAILED DESCRIPTION

Figure 1:
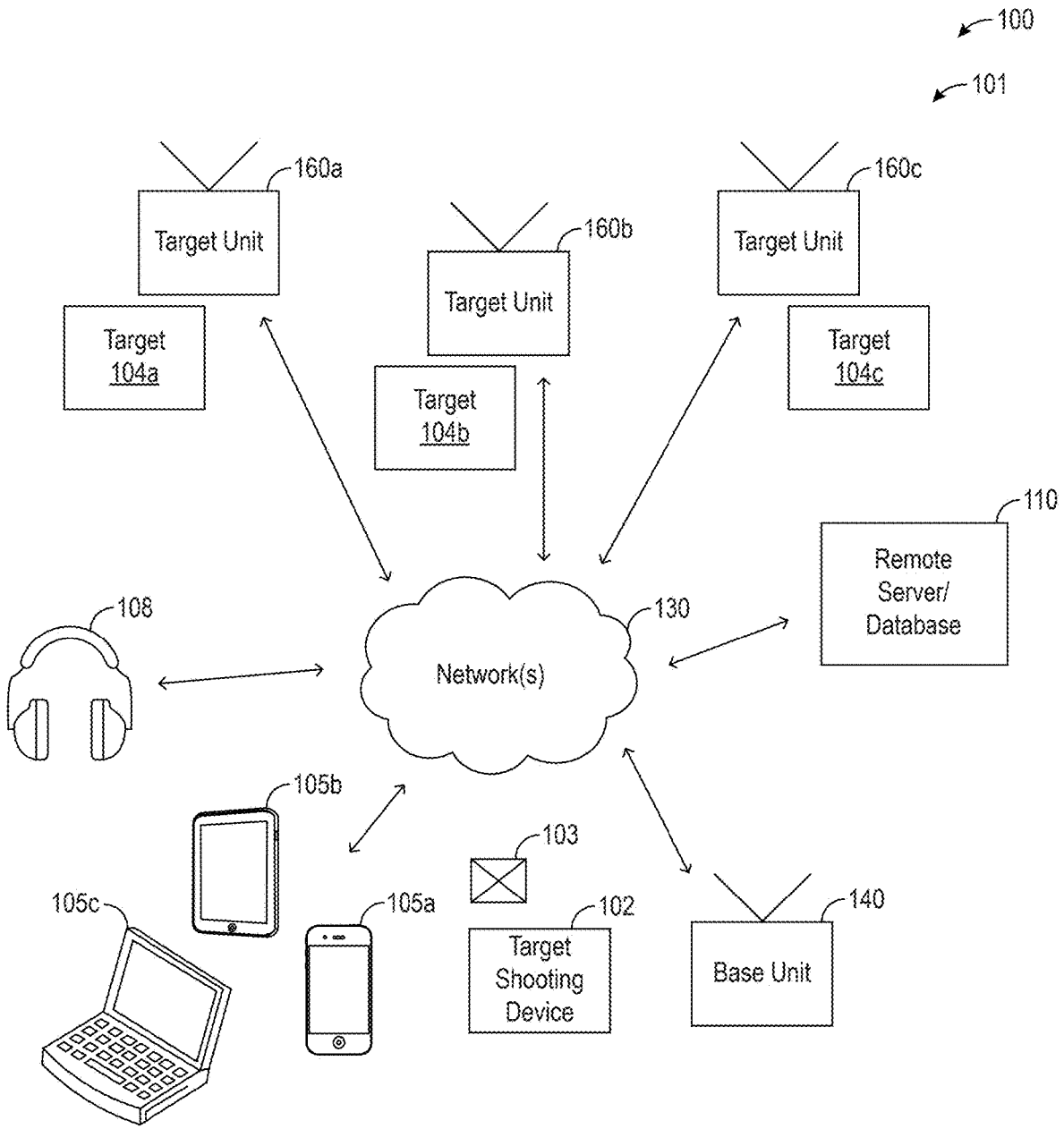
FIG. 1 is a partially schematic diagram of an example environment for a target shooting, gaming, and data acquisition system configured in accordance with various embodiments of the present technology.

The present disclosure is generally directed to target shooting, gaming, and data acquisition systems, and associated devices and methods. For example, several embodiments described below are directed to target shooting, gaming, and data acquisition systems that include a base unit, one or more target units, and a software application that can be executed on a user device. The base unit can be set up at or near a location of a shooter, and/or the target unit(s) can be set up at or near locations corresponding to targets. The target unit(s) are each configured to (a) detect projectile hits on a corresponding target and (b) communicate data relating to the projectile hits to the base unit via a communication link. The base unit can be configured to communicate commands to one or more of the target units via the communication link. The commands can be communicated proactively (e.g., before a projectile is shot at one of the targets, or not based on a projectile striking a target) or reactively (e.g., based at least in part on a projectile striking a target). Additionally, or alternatively, the commands can originate from the base unit or from the software application.

A person skilled in the art will understand that the technology may have additional embodiments and that the technology may be practiced without several of the details of the embodiments described below with reference to FIGS. 1-6.

A. OVERVIEW

In the arena of target shooting, confirmation of projectile strikes on targets at close range is easy—the strikes can be easily seen from a shooting location and the sounds of projectiles hitting hard targets are easily heard. Confirmation of projectile strikes on targets at longer ranges, however, is often more difficult. For example, the strike may be difficult or impossible to see from a shooting location with the naked eye. As another example, because sound level reduction follows the inverse square law, the sounds of projectiles hitting targets may be difficult to hear at the longer ranges or as firearm caliber decreases.

One solution to confirming projectile strikes at longer ranges is to employ long-range hit indicators. For example, a hit indicator can be attached to a backside of a target or to equipment from which the target is hung. When the target is hit by a projectile, the hit indicator can flash, thereby communicating confirmation of the target strike back to the shooter. Such hit indicators, however, are "dumb" in that they are passive devices that only communicate in one direction and only to confirm a target strike.

In contrast, several embodiments of the present technology are directed to target shooting, gaming, and data acquisition systems that offer (a) greater flexibility and control over a target shooting setup and (b) greater data acquisition capabilities. For example, several embodiments described below are directed to target shooting, gaming, and data acquisition systems that include a base unit and one or more target units. The base unit can be set up at or near a location of a shooter (or at another location apart from the location of the shooter), and the target unit(s) can be set up at or near locations corresponding to targets. The base unit and the target unit(s) can be configured to communicate with one another over a network (e.g., a communication channel, a communication link, a communication mesh, etc.). For example, the base unit can send data and/or commands to one or more of the target units via the network, and the target units can send data and/or commands to the base unit and/or to one another via the network.

As a specific example, the target unit(s) can (a) detect projectile hits on a corresponding target and (b) communicate data relating to the projectile hits to the base unit via the network. The target unit(s) may also include one or more sensors for collecting other data (e.g., position data, temperature data, barometric pressure data, altitude data), and may communicate all or a subset of this data to the base unit via the network. Additionally, or alternatively, the target unit(s) and/or the base unit can include visual indicators, speakers, and/or haptic feedback devices for visually, audibly, and/or tactilely conveying target hit/miss and/or other data to a shooter or other user.

As another example, the base unit can communicate commands to one or more of the target units via the network. The commands can originate from the base unit. Alternatively, as discussed in greater detail below, the commands can originate from a software application running on a user device in communication with the base unit.

In some embodiments, the commands can be communicated proactively (e.g., before a projectile is shot at one of the targets, or independent of a projectile striking a target) or reactively (e.g., based at least in part on a projectile striking a target). In these and other embodiments, the commands include instructions for controlling visual indicators, speakers, haptic feedback devices, sensors, and/or other input/output devices of the target units. As a specific example, the base unit can communicate a first command to a target unit via the network and before a projectile is shot at a target corresponding to the target unit. The first command can include instructions for the target unit to emit, via visual indicators of the target unit, a first color of light and/or light at a first strobe frequency. In response to receiving the command, the target unit can emit the first color of light and/or light at the first strobe frequency. Continuing with this example, when the target unit thereafter detects that a projectile has hit the corresponding target, the target unit can communicate data relating to the hit to the base unit via the network. Additionally, or alternatively, the target unit can, (i) based at least in part on detecting that the corresponding target was hit and/or (ii) based at least in part on receiving a second command from the base unit that is transmitted to the target unit via the network responsive to the data relating to the hit, emit a second color of light and/or light at the first strobe frequency or a second, different strobe frequency.

As discussed above, the base unit can, in some embodiments, communicate with a software application running on a user device separate from the base unit. For example, the base unit can communicate with a software application via a second network. As a specific example, the base unit can send the software application information received from the target units and/or generated at the base unit. Such information can include positional information, sensor information (e.g., temperature, barometric pressure, altitude), target hit/miss information, time of shot information, time of target hit information, hit accuracy and/or precision information, information relating to a single user/shooter, and/or information relating to multiple users/shooters, among other information. The software application can process and/or store all or a subset of this information. For example, the software application can calculate various performance indices (e.g., shooter score, accuracy, precision, reaction time, etc. related to a current shooting session and/or to multiple shooting sessions over time) and/or ballistic indices (e.g., projectile time of flight, projectile velocity, drag functions, deceleration, ballistic coefficient, etc.) based at least in part on information received from the base unit and/or generated at the user device. As another example, the software application can store all or a subset of the information locally on the user device and/or on a remote server/database, and/or can present all or a subset of the information to a user/shooter via a user interface. As still another example, the software application can communicate with a user's/shooter's hearing protection device, and can convey all or a subset of the information to a user/shooter via the hearing protection device.

As another specific example, the software application can issue commands to the base unit and/or to one or more of the target units. As discussed above, the commands can be proactive and/or reactive. Such ability to proactively and/or reactively control the target unit(s) and/or the base unit can enable the software application and/or the base unit to manage and/or score various shooting activities (e.g., shooting competitions, trainings, games, etc.) for a single user/shooter and/or for multiple users/shooters. In the case of multiple users/shooters, shooting activities can be conducted entirely locally (e.g., using one or more target shooting, gaming, and data acquisition systems; tracking and/or scoring shooting data associated with each user/shooter) or at least partially remotely (e.g., using multiple target shooting, gaming, and data acquisition systems that communicate via a network (e.g., the internet) and/or using severs/databases).

B. SELECTED EMBODIMENTS OF TARGET SHOOTING, GAMING, AND DATA ACQUISITION SYSTEMS, AND ASSOCIATED DEVICES AND METHODS

Certain details are set forth in the following description and in FIGS. 1-6 to provide a thorough understanding of various embodiments of the present disclosure. Other details describing well-known structures and systems often associated with target shooting and associated methods are not set forth below to avoid unnecessarily obscuring the description of various embodiments of the disclosure. Furthermore, many of the details, dimensions, angles, and other features shown in FIGS. 1-6 are merely illustrative of particular embodiments of the disclosure. Accordingly, other embodiments can have other details, dimensions, angles, and features without departing from the spirit or scope of the present disclosure.

FIG. 1 is a partially schematic diagram of an example environment 100 in which a target shooting, gaming, and data acquisition system 101 ("system 101") configured in accordance with various embodiments of the present technology can operate. As shown, the environment 100 includes a target shooting device 102 and targets 104 (identified individually in FIG. 1 as targets 104*a*-104*c*). The shooting device 102 can include a firearm (e.g., a handgun/pistol, a rifle, a shotgun), an air gun, a bow (e.g., a compound bow, long bow, crossbow), a slingshot, or another suitable shooting device or ranged weapon.

In the illustrated embodiment, the targets 104*a*-104*c* are positioned at locations corresponding to various shooting distances from a shooting location 103 (e.g., a shooting bench or other location from which a shooter uses the shooting device 102 to shoot projectiles at the target 104*a*-104*c*). For example, the target 104*a* and the target 104*b* in FIG. 1 are positioned at two different locations that each corresponds to a first shooting distance from the shooting location 103, and the target 104*c* is positioned at a location that corresponds to a second shooting distance from the shooting location 103 that is different from the first shooting distance. In other embodiments, the targets 104*a*-104*c* can be positioned at locations that each corresponds to a same shooting distance from the shooting location 103, or the targets 104*a*-104*c* can be positioned at locations that each corresponds to a different shooting distance from the shooting location 103. In these and other embodiments, any suitable arrangement of the targets 104 with respect to one another and/or with respect to the shooting location 103 can be used.

The targets 104*a*-104*c* can include hard and/or soft targets. For example, one or more of the targets 104*a*-104*c* can be made of paper, steel, rubber, and/or another suitable material. Additionally, or alternatively, one or more of the targets 104*a*-104*c* can be freestanding or mounted on/affixed to other equipment (e.g., stands, cables) or backstops (e.g., metal plates, wood, cardboard, ballistics gel). Two or more of the targets 104*a*-104*c* can be identical or at least generally similar to each other, or all of the targets 104*a*-104*c* can differ from one another. As a specific example, at least one of the targets 104*a*-104*c* can be a steel target (e.g., an AR500 steel target), or can be affixed to a hard (e.g., steel) backstop. As another specific example, at least one of the targets 104*a*-104*c* can be a soft target (e.g., for archery), or can be affixed to an archery field bag or other soft backstop.

Although three targets 104 are shown in the environment 100 illustrated in FIG. 1, other environments can include any other suitable number of targets 104 (e.g., one, two, or more than three targets 104). Additionally, or alternatively, although one shooting device 102 and one shooting location 103 are shown in the environment 100 of FIG. 1, other environments can include multiple shooting devices 102 and/or multiple shooting locations 103, with all or a subset of the shooting devices 102 and/or all or a subset of the shooting locations 103 corresponding to a same shooter or to different shooters.

The target shooting, gaming, and data acquisition system 101 ("the system 101") includes a base unit 140 and one or more target units 160. In the illustrated embodiment, the one or more target units 160 include three target units 160 that are identified individually in FIG. 1 as target units 160*a*-160*c*. Each of the target units 160*a*-160*c* can be positioned at or near the location of a corresponding one of the targets 104*a*-104*c*. For example, as discussed in greater detail below, at least a portion of each of the target units 160*a*-160*c* can be attached to the corresponding one of the targets 104*a*-104*c* in some embodiments of the present technology. Although the system 101 includes three target units 160 in FIG. 1, systems configured in accordance with other embodiments of the present technology can include any other suitable number of target units 160 (e.g., one, two, or more than three target units 160). Additionally, or alternatively, although each of the target units 160*a*-160*c* is illustrated in FIG. 1 as corresponding to a different one of the targets 104*a*-104*c*, multiple target units 160 can correspond to and/or be positioned at or near a same target 104 in other embodiments of the present technology.

The base unit 140 can be positioned at or near the shooting location 103, the shooting device 102, and/or one or more user devices 105. Additionally, or alternatively, the base unit 140 can be positioned at a location remote from the shooting location 103, the target shooting device 102, and/or the one or more user devices 105. The base unit 140 can connect to and/or communicate with the target units 160*a*-160*c* over one or more networks 130 (e.g., communication channels, communication links, etc.) that facilitate communication in the environment 100. The one or more networks 130 can include one or more wireless networks, such as, but not limited to, one or more of a Local Area Network (LAN), Wireless Local Area Network (WLAN), a Personal Area Network (PAN), Campus Area Network (CAN), a Metropolitan Area Network (MAN), a Wide Area Network (WAN), a Wireless Wide Area Network (WWAN), Global System for Mobile Communications (GSM), Personal Communications Service (PCS), Digital Advanced Mobile Phone Service (D-Amps), Bluetooth, Bluetooth Low Energy ("BLE"), Zigbee, Wi-Fi, Fixed Wireless Data, 2G, 2.5G, 3G, 3.75G, 4G, 5G, LTE networks, enhanced data rates for GSM evolution (EDGE), General packet radio service (GPRS), enhanced GPRS, messaging protocols such as, TCP/IP, SMS, MMS, extensible messaging and presence protocol (XMPP), real time messaging protocol (RTMP), instant messaging and presence protocol (IMPP), instant messaging, USSD, IRC, or any other wireless data networks or messaging protocols. The network(s) 130 may additionally, or alternatively, include one or more wired networks.

As a specific example, the base unit 140 can connect to and/or communicate with the target units 160*a*-160*c* using a two-way radio communication protocol, such as LoRa or another long-range radio technology. The one or more networks 130 can enable the base unit 140 to connect to and/or communicate with the target units 160*a*-160*c* over various distances between approximately zero yards (zero meters) and approximately 1,000 yards (914.4 meters) or more, such as between approximately zero yards and (b) 10 yards (9.14 meters), 25 yard (22.86 meters), 50 yards (45.72 meters), 100 yards (91.44 meters), approximately 150 yards (137.16 meters), approximately 200 yards (182.88 meters), approximately 250 yards (228.6 meters), approximately 300 yards (274.32 meters), approximately 400 yards (365.76 meters), approximately 500 yards (457.2 meters), approximately 600 yards (548.64 meters), approximately 700 yards (640.08 meters), approximately 800 yards (731.52 meters), and/or approximately 900 yards (822.96 meters). In some embodiments, the base unit 140 can connect to and/or communicate with the target units 160*a*-160*c* individually and/or collectively. For example, the base unit 140 can communicate information to and/or receive information from all or a subset of the target units 160*a*-160*c* at the same time. Additionally, or alternatively, the target units 160*a*-160*c* can each include a unique identifier, which can enable the base unit 140 to (a) address communications to a specific one or a specific subgrouping of the target units 160*a*-160*c* and/or (b) identify communications from a specific one or a specific subset of the target units 160*a*-160*c*.

Additionally, or alternatively, the base unit 140 can connect to and/or communicate with the one or more user devices 105 over the one or more networks 130. For example, the base unit 140 can connect to and/or communicate with a software application of the system 101 that is running on the user device(s) 105. As a specific example, the base unit 140 can connect to and/or communicate with the one or more user devices 105 using Wi-Fi, Bluetooth, Bluetooth Low Energy ("BLE"), Zigbee, or another suitable communication means. In some embodiments, the base unit 140 can include or be configured to provide its own WLAN. The one or more user devices 105 can include cellular telephones, wearable electronics, tablet devices, handheld or laptop devices, personal computers, server computers, multiprocessor systems, microprocessor-based systems, programmable consumer electronics, network PCs, minicomputers, mainframe computers, distributed computing environments that include any of the above systems or devices, or the like. Three user devices 105 are shown in FIG. 1 and are individually identified as user devices 105*a*-105*c*.

In some embodiments, the base unit 140 can be configured as a communications hub that enables the software application executed on the user device(s) 105 to communicate with one or more of the target units 160*a*-160*c*. For example, as discussed in greater detail below, the target units 160*a*-160*c* can be equipped with visual indicators (e.g., LEDs, RGB LEDs, ultra-bright LEDs, other illumination devices). Continuing with this example, the software application on the user device(s) 105 can be used to instruct specific ones of the target units 160*a*-160*c* to emit light according to a first set of properties. As specific examples, the software application can be used to instruct the specific ones of the target units 160*a*-160*c* to emit (a) a first color of light (e.g., green); (b) a first sequence of light pulses of one or more colors (e.g., green, blue, green, blue, etc.) and/or one or more durations (e.g., 1 second per light pulse, or green for 1 second then blue for 2 seconds); and/or (c) a first set of light pulses at a first strobe frequency (e.g., 30 light pulses or flashes per second). These instructions can be communicated to the base unit 140 via the network(s) 130 (e.g., using Wi-Fi, Bluetooth, Bluetooth Low Energy ("BLE"), Zigbee, or another suitable communication means), and the base unit 140 can communicate the instructions to all or the specific ones of the target units 160*a*-160*c* via the network(s) 130 (e.g., using a two-way, long-range radio technology or another suitable communication means). In response to receiving the instructions from the base unit 140, the specific ones of the target units 160*a*-160*c* can, using their respective visual indicators, emit light according to the first set of properties.

Continuing with the above example, when a shooter thereafter hits one of the targets 104*a*-104*c* corresponding to one of the target units 160*a*-160*c* that is currently emitting light according to the first set of properties, the corresponding one of the target units 160*a*-160*c* can (a) detect the hit, (b) stop emitting light according to the first set of properties and/or start emitting light according to a second set of properties (e.g., one or more second colors, sequences, durations, strobe/flash frequencies, etc.), and/or (c) communicate the target hit to the base unit 140 via the network(s) 130 (e.g., using LoRa radio technology or another suitable communication means). In turn, the base unit 140 can communicate the target hit and/or other information to the software application running on the user device(s) 105 via the network(s) 130 (e.g., using Wi-Fi, Bluetooth, Bluetooth Low Energy ("BLE"), Zigbee, or another suitable communication means). Additionally, or alternatively, the one or more user devices 105 can connect to and/or communicate with one or more of the target units 160*a*-160*c* directly (e.g., without first going through the base unit 140).

In some embodiments, two or more of the target units 160*a*-160*c* can be configured to connect to and/or communicate with each other over the one or more network(s) 130. For example, two or more of the target units 160*a*-160*c* can be configured to communicate with each other via the base unit 140, such as using a two-way radio technology (e.g., LoRa) or another suitable communication means. As another example, two or more of the target units 160*a*-160*c* can be configured to communicate with each other directly, such as using two-way radio, Wi-Fi, Bluetooth, Bluetooth Low Energy ("BLE"), Zigbee, or another suitable communication means. As a specific example, the target units 160*a*-160*c* can be configured to determine an arrangement of the target units 160*a*-160*c* with respect to the shooting location 103 and/or the base unit 140. More specifically, the target units 160*a*-160*c* and/or the base unit 140 can communicate with one another over the one or more network(s) 130 to determine their locations relative to one another (e.g., using signal pings and/or round-trip times, using GPS readings), which in some cases can be used to determine their locations relative to the shooting location 103 (e.g., if the position of the base unit 140 to the shooting location 103 is known or can be determined, such as using an optical sensor of the base unit 140 and/or one or more sensors of a user device 105). All or a subset of this information can be relayed to the software application running on the one or more user devices 105 (e.g., for display to a user/shooter in whole or in part, or to inform one or more features of the software application).

As shown in FIG. 1, the environment 100 and/or the system 101 can further include one or more hearing protection devices 108. The one or more hearing protection device(s) 108 can include a hearing protection device of a shooter and/or a hearing protection device of an observer/bystander. In some embodiments, the software application running on the user device(s) 105 and/or the base unit 140 can connect to and/or communicate with the hearing protection device(s) 108 via the one or more network(s) 130, such using Wi-Fi, Bluetooth, Bluetooth Low Energy ("BLE"), Zigbee, or another suitable communication means. As a specific example, the one or more user device(s) 105 can stream music or other audio to the hearing protection device(s) 108, and the software application can be configured to mute the music/other audio to convey various information (e.g., hit/miss information, accuracy/precision information, ballistics information, etc.) to users/shooters via the hearing protection device(s) 108.

The system 101 can optionally include one or more remote servers and/or databases 110. The base unit 140, the target units 160*a*-160*c*, and/or the software application running on the user device(s) 105 can connect to and/or communicate with the one or more remote servers/databases 110. For example, the base unit 140, the target units 160*a*-160*c*, and/or the software application running on the user device(s) 105 can communicate with the one or more servers/databases 110 to retrieve information from or transmit information to the one or more servers/databases 110. In some embodiments, a remote server/database 110 can be an edge server which receives client requests and coordinates fulfillment of those requests through other servers. The remote servers/databases 110 can comprise computing systems. Although the remote servers/databases 110 are displayed logically as a single server/database, the remote servers/databases 110 can be a distributed computing environment encompassing multiple computing devices and/or databases located at the same or at geographically disparate physical locations. In some embodiments, the remote servers/databases 110 correspond to a group of servers.

The remote servers/databases 110 can include one or more databases. The one or more databases can warehouse (e.g. store) information such as user accounts/profiles, shooting data (e.g., target hit/miss data, accuracy/precision data, ballistics data), scoring/leaderboard information (e.g., scoring information) related to one or multiple users, shooting games, drivers/software necessary to operate certain applications and/or devices, and/or other information. Storing such information in the databases can enable later retrieval and/or review of the information on a user device 105 (e.g., with or without the user device 105 being paired to a base unit 140), and/or sharing of such information with other users/shooters. All or a subset of the information storable in the databases can additionally, or alternatively, be stored locally on the user device(s) 105, the base unit 140, and/or the target units 160*a*-160*c*. In some embodiments, the one or more user devices 105, the base unit 140, the one or more target units 160*a*-160*c*, and/or the one or more remote servers/databases 110 can each act as a server or client to other server/client devices.

Although the system 101 of FIG. 1 is shown with a single base unit 140, target shooting, gaming, and data acquisition systems configured in accordance with other embodiments of the present technology can include more than one base unit 140. For example, a target shooting, gaming, and data acquisition system of the present technology can include multiple base units 140 that are each associated with different shooters/shooting locations and/or that are each configured to communicate with a same set or a different set of target units 160. In some embodiments, a base unit 140 can be configured as a target unit 160, and/or a target unit 160 can be configured as a base unit 140.

Figure 2:
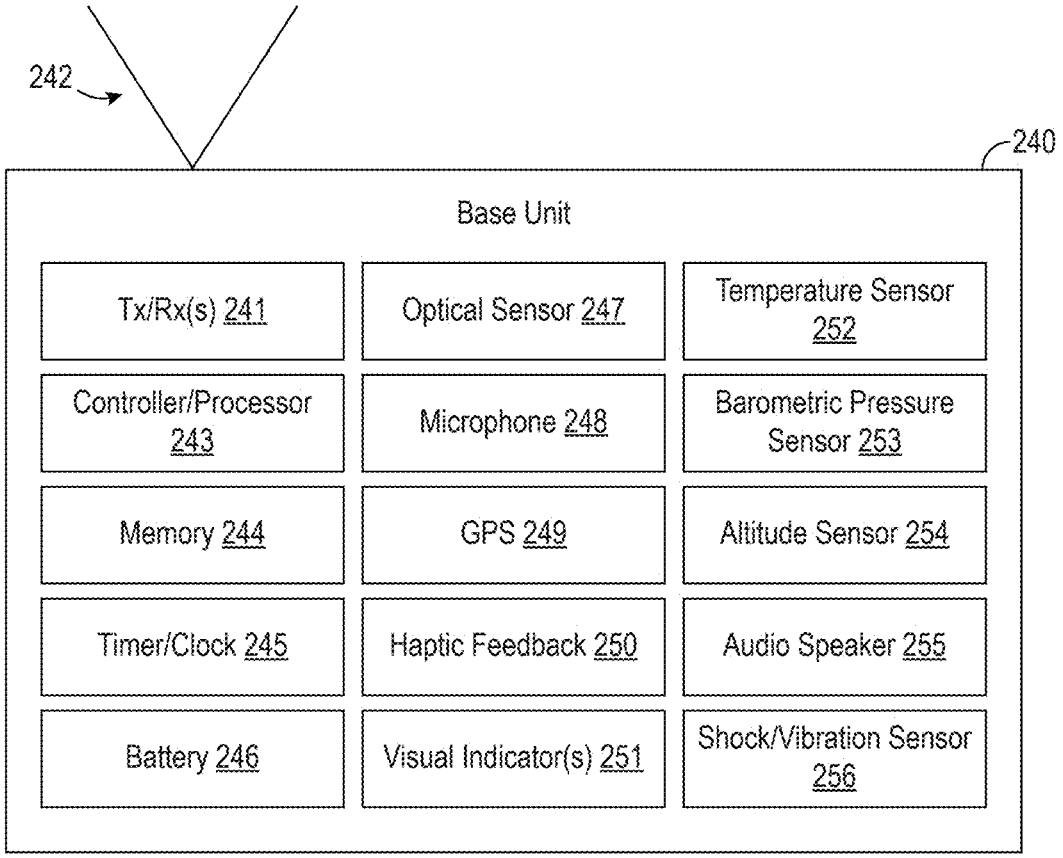
FIG. 2 is a partially schematic block diagram of a base unit of a target shooting, gaming, and data acquisition system configured in accordance with various embodiments of the present technology.

FIG. 2 is a partially schematic block diagram of a base unit 240 of a target shooting, gaming, and data acquisition system (e.g., the system 101 of FIG. 1) configured in accordance with various embodiments of the present technology. The base unit 240 can be the base unit 140 of FIG. 1 or another base unit configured in accordance with various embodiments of the present technology. As discussed above, the base unit 240 is configured to manage communications between one or more target units (e.g., one or more of the target units 160*a*-160*c* of FIG. 1), a software application running on one or more user devices (e.g., the one or more user devices 105*a*-105*c* of FIG. 1), and/or one or more remote servers/databases (e.g., the one or more remote servers/databases 110 of FIG. 1). In this regard, individual ones of the target units, the user devices, and/or the remote servers/databases can directly or indirectly communicate with the base unit 240 over one or more wired or wireless connections. For example, individual ones of the target units, the user devices, and/or the remote servers/databases can be paired with the base unit 240 and/or can communicate with the base unit 240 using two-way radio, Wi-Fi, Bluetooth, Bluetooth Low Energy ("BLE"), Zigbee, hardwired, and/or one or more other suitable communication means. As a more specific example, individual ones of the target units can communicate various information (e.g., target hit/miss information, status data (e.g., battery life, position data, error data), and/or other information) directly to the base unit 240 (e.g., using two-way radio technology). In turn, the base unit 240 can communicate all or a subset of the information to a software application running on one or more user devices paired with the base unit 240. Additionally, or alternatively, the base unit 240 can directly or indirectly communicate all or a subset of the information to one or more remote servers/databases (e.g., for storage in database entries associated with a user). As another specific example, a software application running on a user device that is currently paired with the base unit 240 can communicate instructions intended for one or more target units to the base unit 240 (e.g., using Bluetooth, WiFi, Zigbee, or another communication means). In turn, the base unit 240 can communicate all or a subset of the instructions to the one or more target units (e.g., using two-way radio or another suitable communication means).

As shown, the base unit 240 can include corresponding transceivers 241 (or separate transmitters and receivers) for facilitating such communications. For example, the transceivers 241 of the base unit 240 can include (a) a first transceiver (or a first transmitter and a first receiver) to transmit/receive information to/from one or more target unit(s), and (b) a second transceiver (or a second transmitter and a second receiver) to transmit/receive information to/from one or more user devices. The base unit 240 may also include one or more antennas 242 (e.g., to improve signal strengths and/or extend the range of communications between (i) the base unit 240 and (ii) the target unit(s) and/or the user device(s)).

As shown, the base unit 240 can include one or more controllers or processors 243 that are configured to process information generated or collected at, sent by, and/or received at the base unit 240. The one or more controllers or processors 243 are configured to execute instructions stored in memory 244, including various processes, logic flows, and routines for controlling operation of the base unit 240 and/or for managing communications between the various electrical circuits and devices on and/or connected to the base unit 240. In some embodiments, the memory 244 used to store the instructions can include non-volatile and/or volatile memory. For example, the memory 244 can include electrically erasable programmable read-only memory ("EEPROM"), double data rate (any generation) dynamic random-access memory ("DDR DRAM"), and/or NAND flash memory ("NAND flash"). The EEPROM, for example, can be configured to store boot instructions of the base unit 240. The DDR DRAM can permit high speed data transfers while the base unit 240 remains powered on and/or while power is supplied to the base unit 240 from a battery 246 or other power source. The NAND flash can provide non-volatile memory storage (e.g., to store system, user, and/or other information). Use of other and/or different memory 244 in the base unit 240 is of course possible and within the scope of the present technology.

The controllers or processors 243 can include two-way radio (e.g., LoRa) or other suitable controllers/processors that manage communications between the base unit 240 and the target unit(s). Additionally, or alternatively, the controllers or processors 243 can include Wi-Fi and/or Bluetooth controller(s). A Wi-Fi controller (e.g., an IEEE 802.11 b/g/n/RF/Baseband/Medium Access Control (MAC) link controller or other suitable WiFi controller) can allow the base unit 240 to wirelessly connect to the internet. In some embodiments, the Wi-Fi controller can wirelessly connect to the internet by leveraging TV white space channels or by other suitable means. A Bluetooth controller (e.g., a Bluetooth 4.0 compliant module or controller, or another suitable Bluetooth controller) can allow the base unit 240 to communicate with Bluetooth compatible devices. In some embodiments, the Bluetooth module can be optimized for low power consumption.

As shown, the base unit 240 can include a battery 246. The battery 246 can include one or more disposable batteries and/or one or more rechargeable batteries. In the case of one or more rechargeable batteries, the rechargeable batteries can be readily removed and/or replaced, and/or the rechargeable batteries can be recharged wirelessly or via a charging port (not shown) on the base unit 240. In some embodiments, the battery 246 can include a non-lithium-based battery, such as an alkaline battery, a (e.g., manganese-based or zinc-based) aqueous metal oxide battery, a sodium-ion battery, a carbon-zinc battery, or another suitable battery. In other embodiments, the battery 246 can include a lithium-based battery. In some embodiments, the controller/processor 243 is configured to monitor the status of the battery 246 and communicate battery life information to one or more user devices paired with the base unit 240.

In the illustrated embodiment, the base unit 240 includes various sensors. These sensors include an optical sensor 247, a microphone 248, global positioning system receivers 249 ("GPS 249"), a temperature sensor 252, a barometric pressure sensor 253, an altitude sensor 254, and a shock/impact/vibration sensor 256. One or more of these sensors can be omitted in other embodiments of the present technology. Additionally, or alternatively, the base unit 240 can include one or more other sensors besides those shown in FIG. 2.

The various sensors are each configured to take corresponding measurements and/or detect certain events. For example, the temperature sensor 252 can be configured to take an ambient temperature measurement at a location corresponding to the base unit 240, the barometric pressure sensor 253 can be configured to take a barometric pressure measurement at the location corresponding to the base unit 240, and the altitude sensor 254 can be configured to take an altitude measurement to determine an altitude of the base unit 240. As another example, the GPS 249 can be used to determine a position of the base unit 240. Additionally, or alternatively, the GPS 249 can be used to determine positions of a shooting location, a user device, or a target unit relative to the base unit 240 and/or another point of reference. The base unit 240 can communicate all or a subset of these measurements and/or position data to one or more user devices in communication with the base unit 240 (e.g., for display to a user/shooter). In some embodiments, the base unit 240 can include a unique identifier that can be used by the one or more user devices to attribute sensor measurements to the base unit 240 (e.g., as opposed to one of the target units).

In some embodiments, the optical sensor 247, the microphone 248, and/or the shock/impact/vibration sensor 256 of the base unit 240 can be used in combination with a timer/clock 245 of the base unit 240 to determine (a) a timing of a shot, (b) a timing of a target hit, and/or (c) a target miss. For example, the base unit 240 can be positioned at or near a shooting location. Continuing with this example, the optical sensor 247 can include a camera, and the base unit 240 can be positioned such that the shooting location is within a field of view (FOV) of the camera. In turn, the optical sensor 247 can be used to detect when a projectile is shot toward a target (e.g., by monitoring a trigger of a shooting device or other movement at the shooting location). As another example, the microphone 248 can be used to detect when a projectile is shot toward a target by detecting sound impulses corresponding to the firing of the projectile. The microphone 248 can additionally, or alternatively, be used to detect a target hit by detecting sounds corresponding to the target hit (e.g., in embodiments in which the base unit 240 is positioned near enough to a target to detect the target hit). In these and other embodiments, the microphone 248 can be used to facilitate voice control of the base unit 240.

As still another example, the shock/impact/vibration sensor 256 can be used to detect when a projectile is shot toward a target by detecting concussive forces or other shocks/vibrations corresponding to the firing of the projectile. In some embodiments, a sensitivity of the shock/impact/vibration sensor 256 can be adjustable, such as digitally or physically. As another example, the base unit 240 (or a user device running a software application in communication with the base unit) can be connected to (or include) a trigger sensor to detect when a trigger of a shooting device is pulled and a projectile is shot toward a target. As yet another example, the base unit 240 (or a user device running a software application in communication with the base unit) can be connected to (or include) a muzzle cap that includes a wire that is broken by a projectile as the projectile is fired toward a target, which can be used to determine timing of a shot.

When the base unit 240 detects (e.g., using the optical sensor 247, the microphone 248, the shock/impact/vibration sensor 256, and/or another suitable sensor) that a projectile has been shot toward a target, the timer/clock 245 can be used to record the precise timing of the event. As discussed in greater detail below, a target unit in communication with the base unit 240 can detect when a corresponding target is hit and can communicate a precise timing of the hit back to the base unit 240. In turn, the timing of the shot and the timing of the hit can be used to calculate various information, such as elapsed time of bullet flight, projectile velocity, drag functions, deceleration, ballistic coefficient, and/or other performance indices. These calculations can be performed at the base unit 240 and can then be relayed to one or more user devices (e.g., for display to the shooter). Additionally, or alternatively, the timing information and/or other data measured/collected by the target unit(s) and/or the base unit can be communicated to the one or more user devices in communication with the base unit 240, and the software application running on the one or more user devices can perform one or more of the calculations discussed above.

In these and other embodiments, the timing of a shot detected by the base unit 240 can be used to detect a target miss. For example, as discussed above, a distance between the base unit 240 and one or more target units can be known or determined (e.g., using GPS data, using pings and round-trip times, etc.). Thus, the base unit 240 can detect a target miss when (a) the base unit 240 detects that a projectile has been shot toward a target and (b) a certain amount of time elapses without any of the target units registering a target hit.

In these and still other embodiments, the timing of a shot detected by the base unit 240 can be used to detect or measure other information. For example, the timing of a shot detected by the base unit 240 can be used to measure the reaction time of a shooter. As a specific example, a software application running on a user device in communication with the base unit 240 can instruct a target unit to light up. The target unit can record and/or communicate the timing of when the target unit lights up. Thus, the amount of time elapsed between (a) when the target unit lights up and (b) when the base unit 240 detects the shot or when the target unit registers a target hit, can indicate or correspond to the shooter's reaction time.

In some embodiments, the base unit 240 can include one or more visual indicators 251, an audio speaker 255, and/or a haptic feedback device 250. The visual indicators 251 can include one or more LEDs (e.g., LEDs, RGB LEDs, ultra-bright LEDs) or other suitable illumination devices that can visually convey information (e.g., via colors, flashes, light sequences, etc.). For example, the visual indicators 251 can be used to convey status information, such as successful pairing of the base unit 240 with a software application/user device, a successful communication between the base unit 240 and a target unit, battery life information, and/or connection or other error information. As another example, the visual indicators 251 can be used to convey whether a shooter hit or missed a target (e.g., the visual indicators 251 can flash for a set duration (e.g., one second) and/or display a certain color (e.g., green for target hit, red for target miss) to convey target hit/miss information to a user/shooter). The speaker 255 and/or the haptic feedback device 250 of the base unit 240 can convey all or a subset of this information and/or other information using various sounds and vibrations/tactile feedback, respectively. As discussed in greater detail below, the visual indicators 251, the speaker 255, and/or the haptic feedback device 250 can be controlled via a software application running on a user device paired with the base unit 240.

The various components of the base unit 240 of FIG. 2 are shown positioned within and/or attached to a single housing. In other embodiments of the present technology, various components of the base unit 240 can be located in different housings and/or at different locations. For example, an optical sensor 247 of the base unit 240 can be positioned physically separate from other components of the base unit 240.

Figure 3:
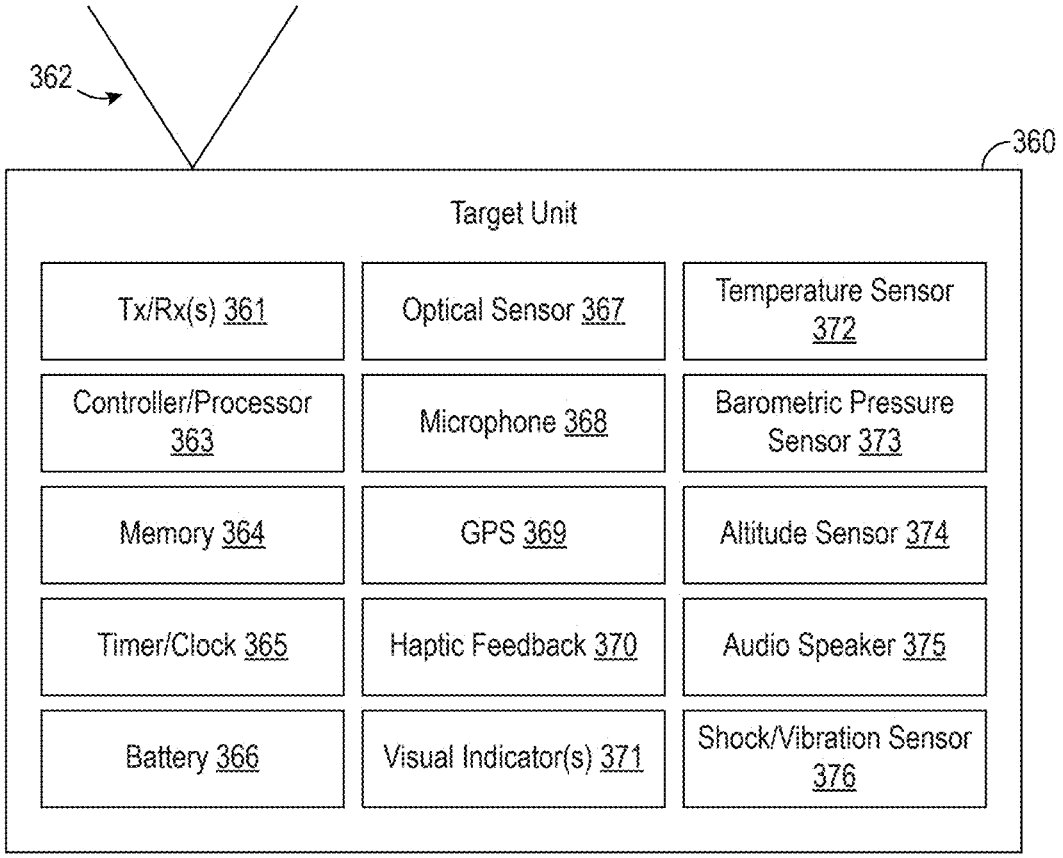
FIG. 3 is a partially schematic block diagram of a target unit of a target shooting, gaming, and data acquisition system configured in accordance with various embodiments of the present technology.

FIG. 3 is a partially schematic block diagram of a target unit 360 of a target shooting, gaming, and data acquisition system (e.g., the system 101 of FIG. 1) configured in accordance with various embodiments of the present technology. The target unit 360 can be one of the target units 160*a*-160*c* of FIG. 1 or another target unit configured in accordance with various embodiments of the present technology. As discussed above, the target unit 360 is configured to communicate information to a base unit and/or to one or more other target units. In this regard, the target unit 360 can directly or indirectly communicate with a base unit and/or one or more other target units over one or more wired or wireless connections. For example, the target unit 360 can communicate with a base unit and/or one or more other target units using two-way radio, Wi-Fi, Bluetooth, Bluetooth Low Energy ("BLE"), Zigbee, hardwired, and/or one or more other suitable communication means. As a more specific example, the target unit 360 can communicate various information (e.g., target hit/miss information, status data (e.g., battery life, position data, error data), and/or other information) directly to the base unit. In these and other embodiments, the target unit 360 can communicate all or a subset of this information and/or other information directly or indirectly (e.g., through a base unit) to one or more other target units.

As shown, the target unit 360 can include corresponding transceivers 361 (or separate transmitters and receivers) for facilitating such communications. For example, the transceivers 361 of the target unit 360 can include a transceiver (or a transmitter and a receiver) to transmit/receive information to/from a base unit. The same transceiver (or transmitter and receiver) can be used to communicate with one or more other target unit(s). Alternatively, the transceivers 361 of the target unit 360 can include another transceiver (or another transmitter and another receiver) used for communications with one or more other target units. The target unit 360 may also include one or more antennas 362 (e.g., to improve signal strengths and/or extend the range of communications between (i) the target unit 360 and (ii) a base unit and/or one or more other target units).

As shown, the target unit 360 can include one or more controllers or processors 363 that are configured to process information generated or collected at, sent by, and/or received at the target unit 360. The one or more controllers or processors 363 are configured to execute instructions stored in memory 364, including various processes, logic flows, and routines for controlling operation of the target unit 360 and/or for managing communications between the various electrical circuits and devices on and/or connected to the target unit 360. In some embodiments, the memory 364 used to store the instructions can include non-volatile and/or volatile memory. For example, the memory 364 can include electrically erasable programmable read-only memory ("EEPROM"), double data rate (any generation) dynamic random-access memory ("DDR DRAM"), and/or NAND flash memory ("NAND flash"). The EEPROM, for example, can be configured to store boot instructions of the target unit 360. The DDR DRAM can permit high speed data transfers while the target unit 360 remains powered on and/or while power is supplied to the target unit 360 from a battery 366 or other power source. The NAND flash can provide non-volatile memory storage (e.g., to store system, user, and/or other information). Use of other and/or different memory 364 in the target unit 360 is of course possible and within the scope of the present technology.

The controllers or processors 363 can include two-way radio (e.g., LoRa) or other suitable controllers/processors that manage communications between the target unit 360 and one or more base units. Additionally, or alternatively, the controllers or processors 363 can include a Wi-Fi controller, a cellular controller, an IoT controller, and/or another suitable controller. Such controllers can allow the target unit 360 to wirelessly connect to the internet (e.g., by leveraging TV white space channels or by other means), and/or may facilitate communication between the target unit 360 and (i) a base unit, (ii) one or more other target units, (iii) one or more user devices, and/or (iv) one or more remote servers/databases.

As shown, the target unit 360 can include a battery 366. The battery 366 can include one or more disposable batteries and/or one or more rechargeable batteries. In the case of one or more rechargeable batteries, the rechargeable batteries can be readily removed and/or replaced, and/or the rechargeable batteries can be recharged wirelessly or via a charging port (not shown) on the target unit 360. In some embodiments, the battery 366 can include a non-lithium-based battery, such as an alkaline battery, a (e.g., manganese-based or zinc-based) aqueous metal oxide battery, a sodium-ion battery, a carbon-zinc battery, or another suitable battery. In other embodiments, the battery 366 can include a lithium-based battery. In some embodiments, the controller/processor 363 is configured to monitor the status of the battery 366 and communicate battery life information to a base unit and/or one or more user devices.

In the illustrated embodiment, the target unit 360 includes various sensors. These sensors include an optical sensor 367, a microphone 368, global positioning system receivers 369 ("GPS 369"), a temperature sensor 372, a barometric pressure sensor 373, an altitude sensor 374, and a shock/impact/vibration sensor 376. One or more of these sensors can be omitted in other embodiments of the present technology. Additionally, or alternatively, the target unit 360 can include one or more other sensors besides those shown in FIG. 3.

The various sensors are each configured to take corresponding measurements and/or detect certain events. For example, the temperature sensor 372 can be configured to take an ambient temperature measurement at a location corresponding to the target unit 360, the barometric pressure sensor 373 can be configured to take a barometric pressure measurement at the location corresponding to the target unit 360, and the altitude sensor 374 can be configured to take an altitude measurement to determine an altitude of the target unit 360. As another example, the GPS 369 can be used to determine a position of the target unit 360. Additionally, or alternatively, the GPS 369 can be used to determine positions of a shooting location, a user device, a base unit, or one or more other target units relative to the target unit 360, the base unit, and/or another point of reference. The target unit 360 can communicate all or a subset of these measurements and/or position data to a base unit and/or to one or more user devices in communication with the base unit (e.g., for display to a user/shooter). In some embodiments, the target unit 360 can include a unique identifier that can be used by the base unit and/or the one or more user devices to attribute sensor measurements to the target unit 360 (e.g., as opposed to the base unit and/or one or more other target units).

In some embodiments, the optical sensor 367, the microphone 368, and/or the shock/impact/vibration sensor 376 of the target unit 360 can be used in combination with a timer/clock 365 of the target unit 360 to determine (a) a timing of a target hit and/or (b) a timing of a target miss. For example, the target unit 360 can be positioned at or near a corresponding target (e.g., one of the targets 104*a*-104*c* of FIG. 1). Continuing with this example, the optical sensor 367 can include a camera, and the target unit 360 can be positioned such that the target is within a field of view (FOV) of the camera. In turn, the optical sensor 367 can be used to detect when a projectile hits the target or a desired spot on the target (e.g., by monitoring a front face of the target). Additionally, or alternatively, the optical sensor 367 can be used to measure, determine, gauge, or score accuracy/precision of a shot, such as by capturing information indicating a distance between (i) a location of a bullseye or another desired spot on the target and (ii) the location at which the projectile hit the target. As another example, the microphone 368 can be used to detect when a projectile hits the target by detecting sound impulses corresponding to the target being hit. The microphone 368 can additionally, or alternatively, be used to detect a target miss or a near miss by detecting sounds corresponding to a projectile passing by the target or hitting the ground or another object near the target. As still another example, the shock/impact/vibration sensor 376 can be used to detect when a projectile hits a target by detecting concussive forces or other shocks/vibrations corresponding to the projectile hitting the target. In some embodiments, a sensitivity of the shock/impact/vibration sensor 376 can be adjustable, such as digitally or physically.

When the target unit 360 detects (e.g., using the optical sensor 367, the microphone 368, the shock/impact/vibration sensor 376, and/or another suitable sensor) a target hit or a target miss, the timer/clock 365 can be used to record the precise timing of the event. As discussed above, the event and/or the corresponding timing information can be communicated to a base unit and/or to one or more other target units. This information can be used in combination with the timing of the shot and/or a known distance between the target/target unit 360 and the base unit/shooting location to calculate various information, such as elapsed time of bullet flight, projectile velocity, drag functions, deceleration, ballistic coefficient, and/or other performance indices. One or more of these calculations can be performed at the target unit 360 (e.g., in embodiments in which a base unit communicates a time of shot to the target unit). Additionally, or alternatively, the timing information and/or other data measured/collected by the target unit 360 can be communicated to a base unit and/or to a software application running on a user device, and one or more of the calculations can be performed at the base unit and/or by the software application.

In these and other embodiments, the timing of a target hit/miss can be used to detect or measure other information. For example, the timing of a target hit detected by the target unit 360 can be used to measure a reaction time of a shooter. As a specific example, the target unit 360 can record and/or communicate a timing of when the target unit 360 lights up (e.g., begins emitting light according to a set of properties, such as one or more colors, sequences, durations, strobe/flash frequencies, etc.). Thus, the amount of time elapsed between (a) when the target unit 360 lights up and (b) when the target unit 360 registers that a corresponding target has been hit, can indicate or correspond to the shooter's reaction time.

The target unit 360 can include one or more visual indicators 371, an audio speaker 375, and/or a haptic feedback device 370. The visual indicators 371 can include one or more LEDs (e.g., LEDs, RGB LEDs, ultra-bright LEDs) or other suitable illumination devices that can visually convey information (e.g., via colors, flashes, light sequences, etc.). For example, the visual indicators 371 can be used to convey status information, such as successful pairing or communication of the target unit 360 with a base unit, battery life information, and/or connection or other error information. As another example, the visual indicators 371 can be used to convey whether a shooter hit or missed a target. For example, the target unit 360 can (e.g., at the direction of a software application running on a user device and/or at the direction of a base unit) use the visual indicators 371 to emit a first color (e.g., green) of light and/or light pulses at a first frequency (e.g., 30 flashes per second). Thereafter, the target unit 360 can control the visual indicators 371 to change the first color of light and/or the first frequency (i) to a second color (e.g., red) and/or a second frequency (e.g., 60 flashes per second) when the target unit 360 detects that a corresponding target has been hit and/or (ii) to a third color (e.g., blue) and/or a third frequency (e.g., 100 flashes per second) in the event the target unit 360 detects a near miss or does not detect that a corresponding target has been hit within a period of time following (a) detection of a shot at a base unit (e.g., indicating a miss) or (b) the timing when the visual indicators 371 started emitting the first color and/or the light pulses at the first frequency (e.g., indicating that the shooter was too slow at hitting the target). As other examples, the visual indicators 371 can initially not be used to emit light and can emit a light when the target unit 360 detects a corresponding target has been hit, or the visual indicators 371 can initially be used to emit light and can stop emitting light when the target unit 360 detects a corresponding target has been hit. As still another example, different sets of properties (e.g., colors, flash frequencies, pulse durations, pulses sequence, etc.) can correspond to different shooters/shooting locations, and the visual indicators 371 can be used to assign a target to a shooter/shooting location by emitting light according to a set of properties corresponding to that shooter/shooting location. As yet another example, the target unit 360 can be configured to use the visual indicators 371 to emit light in accordance with a sequence of targets. Continuing with this example, when another target unit is lit up and the target corresponding to the other target unit is hit, the other target unit can change one or more properties of light emitted (or can stop emitting light altogether) and can communicate the target hit to the target unit 360 (e.g., directly and/or through a base unit). In response, assuming the target unit 360 corresponds to a target that is next in the sequence of targets, the target unit 360 can use the visual indicators 371 to emit light (e.g., according to a given set of properties), signaling to a user/shooter that the target corresponding to the target unit 360 is a next target for the user/shooter to shoot. Other uses of the visual indicators 371 to convey information are of course possible and within the scope of the present technology.

The speaker 375 and/or the haptic feedback device 370 of the target unit 360 can convey all or a subset of the above information and/or other information using various sounds and vibrations/tactile feedback, respectively. As discussed in greater detail below, the visual indicators 371, the speaker 375, and/or the haptic feedback device 370 can be controlled via a software application running on a user device in communication with the target unit 360 (e.g., directly or through a base unit).

The various components of the target unit 360 of FIG. 3 are shown positioned within and/or attached to a single housing. In other embodiments of the present technology, various components of the target unit 360 can be located in different housings and/or at different locations. Two examples of such other embodiments are illustrated in FIGS. 4 and 5 and are discussed in greater detail below.

Figure 4:
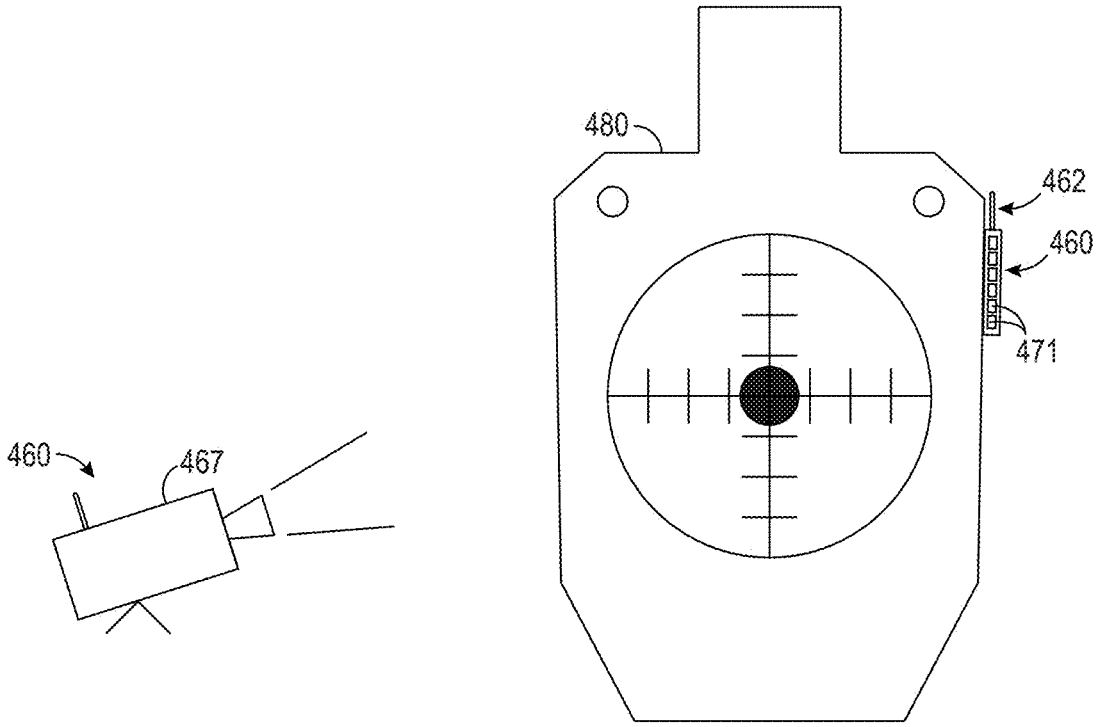
FIG. 4 is a partially schematic diagram of a target unit of a target shooting, gaming, and data acquisition system configured in accordance with various embodiments of the present technology.
Figure 5:
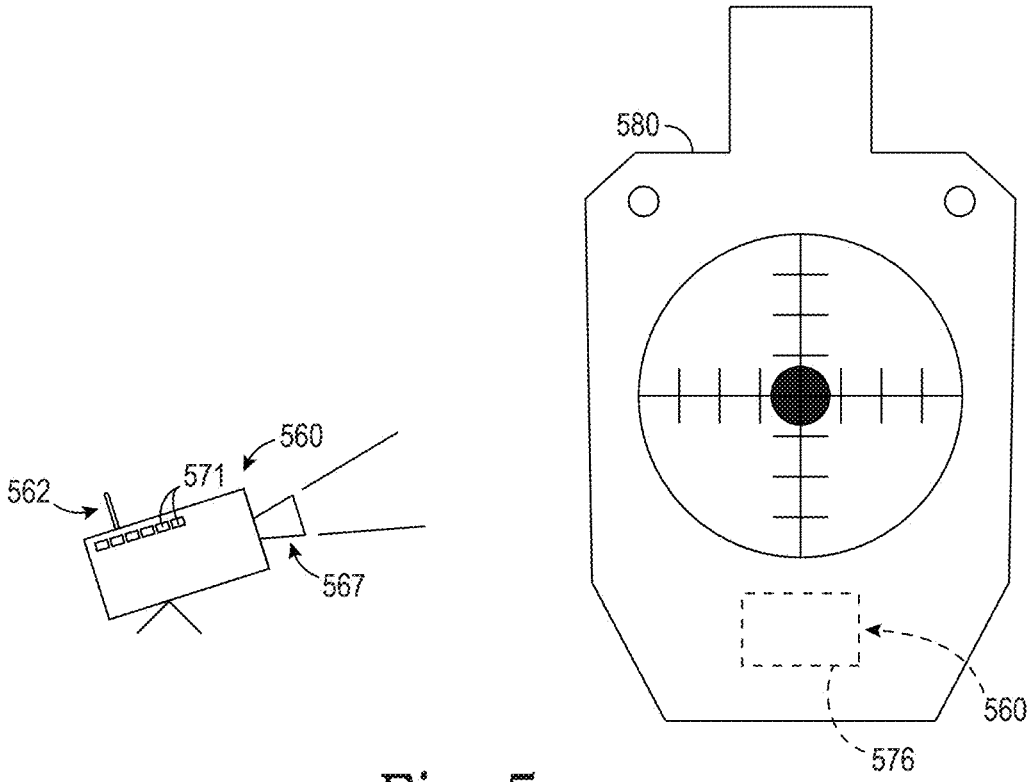
FIG. 5 is a partially schematic diagram of another target unit of a target shooting, gaming, and data acquisition system configured in accordance with various embodiments of the present technology.

FIG. 4 is a partially schematic diagram of a target unit 460 of a target shooting, gaming, and data acquisition system (e.g., the system 101 of FIG. 1) configured in accordance with various embodiments of the present technology. The target unit 460 can be an example of the target unit 360 of FIG. 3, or another target unit configured in accordance with various embodiments of the present technology. In the illustrated embodiment, the target unit 460 is shown installed with a target 480. The target 480 can be an example of one of the targets 104*a*-104*c* of FIG. 1, or another suitable shooting target. For example, the target 480 can be a hard target or a soft target. For the sake of example only, the target 480 is illustrated as an AR500 steel target.

As shown, the target unit 460 can be attached or mounted to the target 480. For example, the target unit 460 can be attached the target 480 using an adhesive, Velcro, clips, mounts, or another suitable attachment mechanism. The target unit 460 can be attached to various areas of the target 480. For example, the target unit 460 can be attached to a front surface or face of the target 480, a back surface or face of the target 480, and/or a side surface or an edge of the target 480. In the illustrated embodiment, the target unit 460 is attached to a backside surface of the target 480. For example, the target unit 460 is attached to a backside surface of the target 480 such that only visual indicators 471 and/or an antenna 462 of the target unit 460 are visible when viewing the target 480 from the front. Such an arrangement can protect a majority of the target unit 460 while exposing only the visual indicators 471 and/or the antenna 462 of the target unit 460 to the possibility of being directly hit by a projectile shot at the target 480.

As discussed above, the visual indicators 471 can include LEDs or other illumination devices. A plurality of visual indicators 471 are shown in FIG. 4. The visual indicators 471 can be individually wired and/or wired in subgroups. This can enable individual and/or subgroup control over the visual indicators 471. Additionally, or alternatively, in the event one of the visual indicators 471 is hit by a projectile, the individual and/or subgroup wiring of the visual indicators 471 can allow visual indicators 471 that are not affected by the projectile strike to continue to emit light and/or convey information. The individual and/or subgroup wiring may also enable quickly swapping out a damaged visual indicator for another functioning visual indicator. In these and other embodiments, the antenna 462 can be removably attached to the target unit 460, thereby allowing the antenna 462 to be quickly swapped out for another antenna in the event the antenna 462 is hit by a projectile.

The target unit 460 may optionally include an optical sensor 467 or camera. In some embodiments, the optical sensor 467 can be physically separate from other components of the target unit 460. As shown, the optical sensor 467 can be positioned near the target 480 such that a front surface or face of the target 480 is within a field of view of the optical sensor 467. As discussed above, the optical sensor 467 can be used to detect when a projectile strikes the target 480. Additionally, or alternatively, the optical sensor 467 can be used to gather information relating to a location on the target 480 at which a projectile hit the target 480. In turn, this information can be used to score precision or accuracy of the shot, such as by determining how far away from a bullseye (or another desired spot) on the target 480 the projectile hit the target 480. Information gathered by the optical sensor 467 can be conveyed wirelessly and/or via a hardwire (i) to the target unit 460 mounted on the target 480 and/or (ii) to a base unit.

FIG. 5 is a partially schematic diagram of another target unit 560 of a target shooting, gaming, and data acquisition system (e.g., the system 101 of FIG. 1) configured in accordance with various embodiments of the present technology. The target unit 560 can be an example of the target unit 360 of FIG. 3, or another target unit configured in accordance with various embodiments of the present technology. In the illustrated embodiment, the target unit 560 is shown installed with a target 580. The target 580 can be an example of one of the targets 104*a*-104*c* of FIG. 1, the target 480 of FIG. 4, or another suitable shooting target. For example, the target 580 can be a hard target or a soft target. For the sake of example only, the target 580 is illustrated as an AR500 steel target.

As shown, the target unit 560 includes a module that can be positioned near the target 580 (e.g., without mounting the module to the target 580). Such an arrangement can reduce the likelihood that components of the target unit 560 located within the module are directly hit by projectiles shot at the target 580. The module of the target unit 560 can include various sensors for detecting target hits and/or misses. For example, the module of the target unit 560 can include a microphone (e.g., similar to the microphone 368 of FIG. 3) and/or an optical sensor 567 (e.g., a camera). When the target unit 560 includes the optical sensor 567, the module of the target unit 560 can be positioned near the target 580 such that a front surface or face of the target 580 is within a field of view of the optical sensor 567. As discussed above, the optical sensor 567 can be used to detect when a projectile strikes the target 580. Additionally, or alternatively, the optical sensor 567 can be used to gather information relating to a location on the target 580 at which a projectile hit the target 580. In turn, this information can be used to score precision or accuracy of the shot, such as by determining how far away from a bullseye (or another desired spot) on the target 580 the projectile hit the target 580.

The target unit 560 may also include various sensors (e.g., a microphone, a shock/impact/vibration sensor, etc.) separate from the module and/or that can be mounted to the target 580. For example, the target unit 560 of FIG. 5 includes a shock/impact/vibration sensor 576 that can be attached the target 580 using an adhesive, Velcro, clips, mounts, or another suitable attachment mechanism. The shock/impact/vibration sensor 576 can be attached to various areas of the target 580. For example, the shock/impact/vibration sensor 576 can be attached to a front surface or face of the target 580, a back surface or face of the target 580, and/or a side surface or an edge of the target 580. In the illustrated embodiment, the shock/impact/vibration sensor 576 is attached to a backside surface of the target 580 such that the shock/impact/vibration sensor 576 is fully protected from being directly hit by a projectile shot at the target 580.

The shock/impact/vibration sensor 576 and/or other sensors (not shown) mounted on the target 580 can be used to detect when the target 580 is hit by a projectile. More specifically, when the target 580 is hit, information collected by the shock/impact/vibration sensor 576 and/or other sensors can be conveyed wirelessly and/or via a hardwire to (i) the module of the target unit 560 located at a position apart from the target 580 and/or (ii) a base unit. In response, the target unit 560 can convey the target hit information to a user/shooter using visual indicators 571 and/or a speaker (not shown) of the target unit 560. Additionally, or alternatively, the target unit 560 can convey the target hit information to a base unit and/or to one or more other target units, such as by using an antenna 562 on the module.

Similar to the visual indicators 471 of FIG. 4, the visual indicators 571 of the target unit 560 can include LEDs or other illumination devices. A plurality of visual indicators 571 are shown in FIG. 5. The visual indicators 571 can be individually wired and/or wired in subgroups. This can enable individual and/or subgroup control over the visual indicators 571. Additionally, or alternatively, in the event one of the visual indicators 571 is directly hit by a projectile or a ricochet, the individual and/or subgroup wiring of the visual indicators 571 can allow visual indicators 571 that are not affected by the projectile strike/ricochet to continue to emit light and/or convey information. The individual and/or subgroup wiring may also enable quickly swapping out a damaged visual indicator for another functioning visual indicator. In these and other embodiments, the antenna 562 can be removably attached to the module of the target unit 560, thereby allowing the antenna 562 to be quickly swapped out for another antenna in the event the antenna 562 is damaged.

Figure 6:
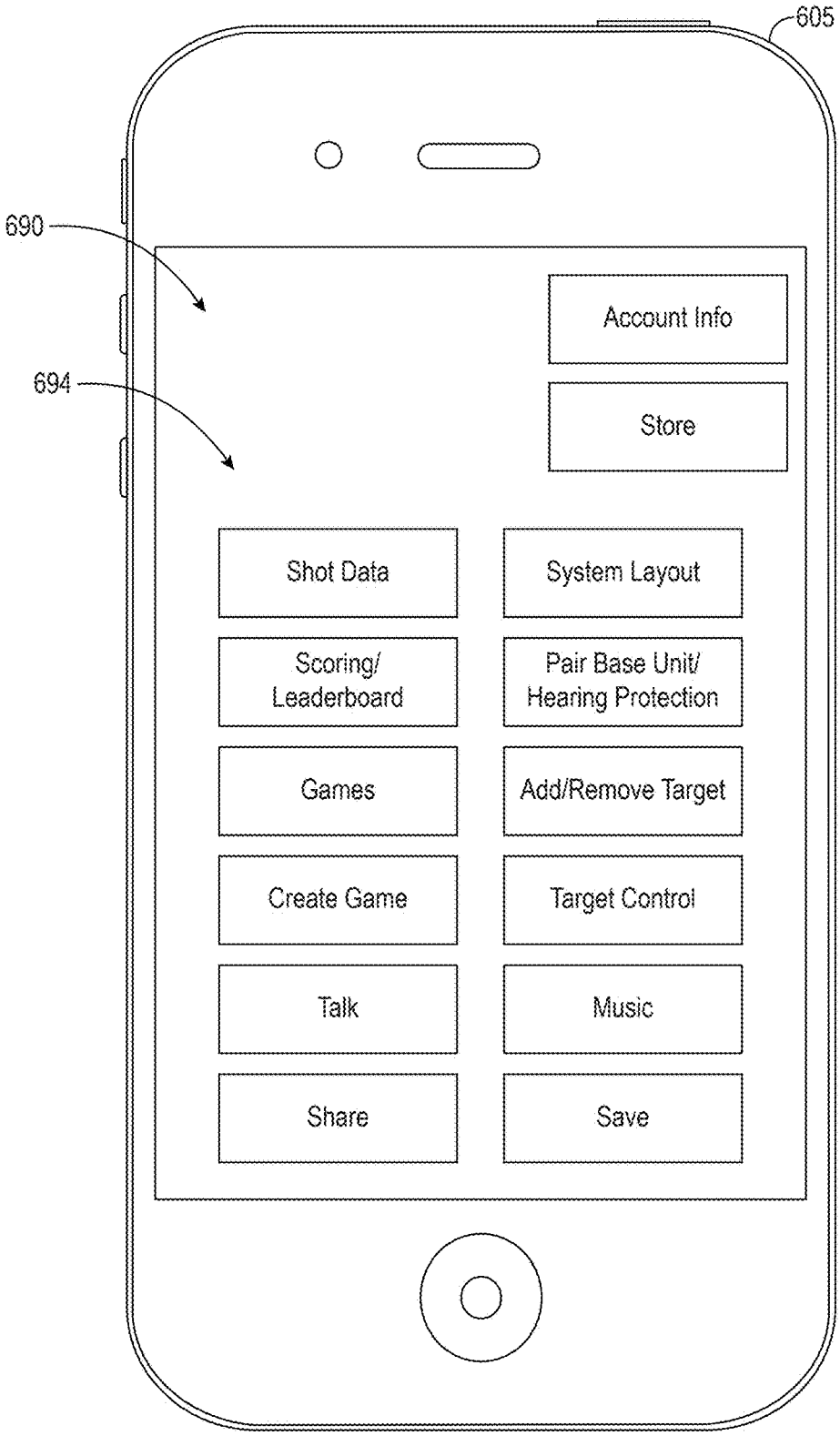
FIG. 6 is a partially schematic block diagram illustrating a user interface of a software application of a target shooting, gaming, and data acquisition system configured in accordance with various embodiments of the present technology.

FIG. 6 is a partially schematic block diagram illustrating a user interface 694 of a software application 690 of a target shooting, gaming, and data acquisition system (e.g., the system 101 of FIG. 1) configured in accordance with various embodiments of the present technology. The software application 690 can be configured to run on a user device 605. The user device 605 can be an example of one of the user devices 105*a*-105*c* of FIG. 1, or another suitable user device.

As discussed above, the software application 690 is configured to communicate with a base unit, one or more remote servers/databases, one or more target units, and/or one or more hearing protection devices. In this regard, the software application 690 can directly or indirectly communicate with one or more remote servers/databases, one or more target units, and/or one or more hearing protection devices over one or more wired or wireless connections (e.g., one or more communication channels, networks, or links). For example, the software application 690 can communicate with a base unit, one or more remote servers/databases, one or more target units, and/or one or more hearing protection devices using two-way radio, Wi-Fi, Bluetooth, Bluetooth Low Energy ("BLE"), Zigbee, hardwired, and/or one or more other suitable communication means. As a more specific example, the software application 690 can communicate various information (e.g., target hit/miss information, ballistics data, status data (e.g., battery life, position data, error data), instructions/commands, and/or other information) directly to the base unit, directly to the remote servers/databases, and/or directly to the hearing protection device(s). In these and other embodiments, the software application 690 can communicate all or a subset of this information and/or other information directly or indirectly (e.g., through a base unit) to one or more target units.

In some embodiments, the software application 690 can leverage hardware and/or software of the user device 605. For example, the software application 690 can use transceivers (or separate transmitters and receivers) and/or antennas of the user device 605 to facilitate communications between the software application 690 and a base unit, a hearing protection device, one or more target units, and/or one or more remote servers/databases. As another example, the software application 690 can use one or more controllers or processors of the user device 605 to process information generated or collected at, sent by, and/or received by the user device 605 and/or the software application 690. As still another example, the software application 690 can use memory of the user device 605 to store various processes, logic flows, and routines (a) for controlling operation of the user device 605, a base unit, one or more hearing protection devices, and/or one or more target units; and/or (b) for managing communications between the various electrical circuits and devices on and/or connected to the software application 690 or the user device 605.

Additionally, or alternatively, the software application 690 can leverage various sensors and/or other features of the user device 605. For example, the software application 690 can capture temperature measurements using a temperature sensor of the user device 605, barometric pressure measurements using a barometric pressure sensor of the user device 605, and/or altitude measurements using an altitude sensor of the user device 605. As another example, the software application 690 can use GPS receivers of the user device 605 to determine (i) a position of the user device 605, (ii) a position of other components (e.g., a base unit, one or more target units, one or more targets) relative to the user device 605 or another reference point, and/or (iii) a shooting location relative to the user device 605 or another reference point. As still another example, the software application 690 can use an optical sensor (e.g., a camera), a microphone, an accelerometer, and/or another sensor of the user device 605 to, for example, detect when a projectile is shot at a target (e.g., by monitoring movement at the shooting location using the optical sensor, the accelerometer, or another sensor of the user device 605; by monitoring sound impulses using the microphone of the user device 605; etc.). In these and other embodiments, the software application 690 can use an optical sensor (e.g., a camera), a microphone, and/or another sensor of the user device 605 to, for example, detect a target hit/miss (e.g., by detecting visual, audible, or other indications received from a base unit and/or one or more target units). As yet other examples, the software application 690 can (a) use a timer/clock of the user device 605 to timestamp the occurrence of specific events, and/or (b) use visual indicators, audio speakers, and/or haptic feedback devices to convey information (e.g., target hit/miss indications) and/or notifications to a user/shooter.

Various features and operations of the software application 690 will now be discussed with reference to the user interface 694 illustrated in FIG. 6. As shown, the software application 690 can enable a user/shooter to create an account that facilitates the software application storing and tracking profile and other information associated with the user/shooter. Such information can include current and/or historical shooting data, store purchases, unlocked features, user preferences, and relationships with other user/shooter accounts, among other information.

The software application 690 can further include a pair base unit feature that (a) can be used to instruct the user device 605 to pair with a base unit of a target shooting, gaming, and data acquisition system; (b) can be used to instruct the user device 605 to disconnect from a base unit; and/or (c) can be used to present instructions/troubleshooting information to a user/shooter to assist him/her with pairing the user device 605 with a base unit.

Similarly, the software application 690 can further include a pair hearing protection device feature that (a) can be used to instruct the user device 605 to pair with one or more hearing protection devices; (b) can be used to instruct the user device 605 to disconnect from one or more hearing protection devices; and/or (c) can be used to present instructions/troubleshooting information to a user/shooter to assist him/her with pairing the user device 605 with one or more hearing protection devices.

In some embodiments, a base unit can automatically connect to a target unit upon power up of the target unit and/or the base unit. In other embodiments, a base unit can connect to a target unit via a pairing routine facilitated, for example, by (i) pushing a button on one or both of the target unit and the base unit and/or (ii) via the user interface 694 of the software application 690. In some embodiments, the base unit can automatically connect with the software application on the user device 605 upon power up of the base unit and/or upon opening the software application 690 on the user device 605. In other embodiments, the base unit can connect with the software application 690 in response to user input received via the user device 605 and/or via the user interface 694, and/or in response to actuation of a pair button on the base unit.

In some embodiments, the software application 690 can be used to store and/or present information related to a layout of (i) a target shooting, gaming, and data acquisition system and/or (ii) an associated environment. For example, the software application 690 can receive information related to a base unit and/or one or more target units of the system. The information can include position information, temperature information, barometric pressure information, altitude information, and/or other information. The software application 690 (*a*) can store this information locally on the user device 605 and/or on one or more remote servers/databases, and/or (b) can process the information (e.g., to determine distances between (i) the user device 605 or a shooting location and (ii) a base unit and/or target unit(s); to determine positions of the target unit(s) and/or the base unit relative to each other; etc.). All or a subset of this information can be displayed to the user/shooter via the user interface 694.

The user interface 694 of the software application 690 can additionally, or alternatively, permit a user to add or remove information relating to a target, a shooting location, a shooting device, a target unit, and/or a base unit. For example, a user/shooter can manually input information relating to a position/arrangement of a shooting location and/or one or more targets (e.g., relative to corresponding target units, relative to a base unit, relative to the shooting location, etc.). Such information can also include other positional information, such as which shooting lane at a range a target/target unit is positioned within/associated with. A user/shooter may also manually enter which shooting device will be used to shoot projectiles at a target. This information can inform certain algorithms (e.g., shot detection algorithms, target miss algorithms, shooter reaction time algorithms) employed by the software application 690, a base unit, and/or one or more target units. This information can also enable the software application 690 to track shooting information for a specific shooting device or a specific type of shooting device. As another example, a user/shooter can manually alter or remove information relating to a target, a shooting location, a shooting device, a target unit, and/or a base unit, such as (i) when changing a position of a shooting location, a target unit, or a target and/or (ii) when switching which shooting device is being used.

The user interface 694 of the software application 690 may also be used to control various features/components of a base unit and/or of one or more target units. For example, a user/shooter can use the user interface 694 to select which of the target units should emit light and/or sounds. As part of the selection, the user interface 694 can be used to select specific color(s), light sequence(s), sound(s), etc. that should be emitted by the selected target units. In response to the user input, the software application 690 can communicate corresponding instructions to a base unit, which can relay the instructions to the selected target units. In turn, the selected target units can emit the lights and/or sounds using their visual indicators and/or audio speakers.

Similarly, the software application 690 can proactively (e.g., before a shot and/or independent of a target hit/miss) and/or reactively control (e.g., after a shot and/or after a target hit/miss) control the visual indicators, speakers, haptic feedback devices, and/or other features/components of one or more target unit(s) and/or of a base unit. For example, the software application 690 can instruct all or a subset of the target units to proactively emit light according to a first set of properties (e.g., one or more colors, sequences, durations, strobe/flash frequencies, etc.). Continuing with this example, the software application 690 can instruct a target unit to change the first set of properties to a second set of properties (e.g., one or more colors, sequences, durations, strobe/flash frequencies, etc.) different from the first set of properties, such as in response to the target unit detecting that a corresponding target was hit with a projectile.

The software application 690 can leverage such proactive and reactive control over the target units and/or the base unit to manage one or more shooting games, competitions, trainings, etc. For example, the software application 690 can facilitate playing whack-a-mole in which the software application 690 instructs a first target unit (e.g., a random target unit or a target unit in a predetermined sequence) to emit lights and/or sounds according to a set of properties and then instructs a second target unit (e.g., another random target unit or a next target unit in the predetermined sequence) to emit lights and/or sounds according to a same or different set of properties after a user successfully hits a target associated with the first target unit. Other examples of games that can be managed by the software application 690 include Simon Says, HORSE, Follow the Leader, Copycat/Sequence, and Pattern Repetition. The software application 690 can manage competitions and/or trainings in a similar manner. In the event of an error (e.g., a lost connection) related to one of the target units during a game, competition, and/or training, the software application 690 can be configured to adjust accordingly and continue the game, competition, and/or training using the remaining target units. The games, competitions, and/or trainings can be preset, user-defined, based on time/speed, based on accuracy, and/or based on precision. Additionally, or alternatively, the games, competitions, and/or trainings can be purchased from a store associated with the software application 690.

In some embodiments, the software application 690 can permit local or virtual competitions. For example, the software application 690 can use different properties of lights and/or sounds for different users/shooters who are locally using a same set of target units, and/or can track scores for multiple users (e.g., on a same system or on different systems). Such functionally can enable use of target shooting, gaming, and data acquisition systems of the present technology in a variety of settings. For example, systems of the present technology can be used to manage and/or score participants in organized events/competitions, operate/manage shooting range activities, and/or facilitate firearm/ranged weapon trainings.

As another example, the software application 690 can communicate game and/or scoring information corresponding to a first user/shooter to one or more remote servers/databases. This information can be retrieved and/or updated by a software application of another target shooting, gaming, and data acquisition system associated with a second user/shooter who is local to or remote from the first user. In this manner, the software application 690 can facilitate two or more different users/shooters participating in a same game, competition, and/or training when the users/shooters are remote from one another and/or using different systems. In a scenario in which two or more systems are local to one another, the software applications and/or base units associated with the systems can communicate with one another (e.g., without first transmitting information to remote servers/databases). Additionally, or alternatively, the software application 690 can track user scoring and can actively manage/update a ranking or leaderboard reflecting (a) the scores of a plurality of users and/or (b) a plurality of scores associated with a same user.

As discussed above, the software application 690 can receive various information from a base unit and/or one or more target units. The various information can include temperature information, barometric pressure information, altitude information, GPS position data, target hit/miss indications, shot accuracy and/or precision information, and/or event timing information, among other information. The software application 690 can store all or a subset of this information locally on the user device 605 and/or on one or more remote servers/databases. Additionally, or alternatively, the software application 690 can process, organize, tabulate, and/or present on the user interface 694 all or a portion of this information. For example, as discussed above, the software application 690 can process position data and event timing information (e.g., time of shot, time of target hit, time of target illumination, etc.) to determine various performance indices, such as time of bullet flight, shooter reaction time, projectile velocity, drag functions, deceleration, and/or ballistic coefficient. As another example, the software application 690 can process image data to determine shot accuracy and/or precision (e.g., distance from a bullseye or other point of reference). As still another example, the software application 690 can track a number of shots taken by a user, a number of target hits (total or per target), a number of target misses (total or per target), and/or a number of target near misses (total or per target). Based at least in part on some of this information, the software application 690 can calculate a shooter accuracy and/or precision score or other performance index. The software application 690 can track shot information for a current system session and/or for multiple system sessions over time. In embodiments in which the software application 690 tracks data corresponding to multiple sessions over time, the software application 690 (*i*) can enable a user to review historical shooting data from previous sessions and/or (ii) can calculate and/or display user performance reports indicating performance improvement or declines over preset and/or user-defined timing windows.

As discussed above, the user device 605 can be paired with a hearing protection device of a user/shooter and/or with hearing protection device(s) associated with one or more other individuals (e.g., a spectator, a spotter, another user/shooter, etc.). In these embodiments, the software application 690 can instruct the user device 605 to stream music or other desired audio to all or a first subset of the paired hearing protection devices. In these and other embodiments, the software application 690 can mute the music/desired audio to convey various information (e.g., target hit/miss information, shot score, game/competition updates, game/competition instructions, etc.) to all or a second subset of the paired hearing devices. Alternatively, the software application 690 can convey the various information to all or a second subset of the paired hearing devices without first muting music or other audio. The second subset can be the same as or different from the first subset. Additionally, or alternatively, the software application 690 can enable a user/shooter to communicate or talk with other individuals (e.g., a spectator, a spotter, another user/shooter, etc.) via (i) the hearing protection devices and/or (ii) a microphone on the user device 605, on the hearing protection devices, on a base unit, and/or on a target unit.

In some embodiments, the software application 690 can enable a user/shooter to selectively save/discard various information (e.g., target shot counts for a single target or for multiple or all targets, target shot misses for a single target or for multiple or all targets), such as locally on the user device 605 and/or on one or more remote servers/databases. In these and other embodiments, the software application 690 can enable a user/shooter to selectively share various information (e.g., scores, ballistic data, performance indices, etc.) with the public, with select users/shooters (e.g., of other systems or associated with other accounts), and/or with other individuals (e.g., via email or otherwise). In these and still other embodiments, the software application 690 can provide notifications to a user/shooter via the user interface 694. For example, the software application 690 can track battery life/level information associated with the user device, a base unit, one or more target units, and/or a hearing protection device, and can present this information on the user interface 694 and/or notify the user/shooter when the battery life/level information indicates that a battery associated with a component of the system needs to be recharged or has dropped below a threshold level. As another example, the software application 690 can track connection statuses (e.g., of a base unit with the software application, or a target unit with the base unit, of a hearing protection device with the software application), and can present this information on the user interface 694 and/or notify the user/shooter of a successful/active connection or a faulty/unsuccessful/lost connection. As still another example, the software application 690 can indicate to a user/shooter on the user interface 694 or in a notification which of the target units is currently active (e.g., emitting lights or sounds, corresponding to next targets to shoot, etc.) and/or inactive (e.g., turned off, not emitting lights or sounds, etc.), such as part of a random or sequenced shooting game.

Although not shown in extreme detail so as to avoid unnecessarily obscuring the description of embodiments of the technology, any of the forgoing systems and methods described above in FIGS. 1-6 can include and/or be performed by one or more computing devices configured to direct and/or arrange components of the systems and/or to receive, arrange, store, analyze, and/or otherwise process data received, for example, from the machine and/or other components of the systems. As such, such computing devices include the necessary hardware and corresponding computer-executable instructions to perform these tasks. More specifically, computing devices configured in accordance with an embodiment of the present technology can include a processor, a storage device, input/output devices, one or more sensors, and/or any other suitable subsystems and/or components (e.g., displays, speakers, communication modules, etc.). The storage device can include a set of circuits or a network of storage components configured to retain information and provide access to the retained information. For example, the storage device can include volatile and/or non-volatile memory. As a more specific example, the storage device can include random access memory (RAM), magnetic disks or tapes, and/or flash memory.

The computing devices can also include computer readable media (e.g., storage devices, disk drives, and/or other storage media, excluding only a transitory, propagating signal per se) including computer-executable instructions stored thereon that, when executed by the processor and/or computing device, cause the systems to perform target shooting, gaming, and data acquisition procedures as described in detail above with reference to FIGS. 1-6. Moreover, the processor can be configured for performing or otherwise controlling steps, calculations, analysis, and any other functions associated with the methods described herein.

In some embodiments, the storage device can store one or more databases used to store data collected by the systems as well as data used to direct and/or adjust components of the systems. In one embodiment, for example, a database is an HTML file designed by the assignee of the present disclosure. In other embodiments, however, data is stored in other types of databases or data files.

One of ordinary skill in the art will understand that various components of the computing device(s) can be further divided into subcomponents, or that various components and functions of the computing device(s) may be combined and integrated. In addition, these components can communicate via wired and/or wireless communication, as well as by information contained in the storage media.

C. EXAMPLES

Several aspects of the present technology are set forth in the following examples. Although several aspects of the present technology are set forth in examples directed to systems and methods, these aspects of the present technology can similarly be set forth in examples directed to methods and systems, respectively, in other embodiments. Additionally, these same aspects of the present technology can be set forth in examples directed to devices and/or to (e.g., non-transitory) computer-readable media in other embodiments.

1. A target shooting system, comprising:
   - a target unit deployable at a first location at or near a location of a target; and
   - a base unit deployable at a second location different from the first location,
   - wherein—
     - the target unit and the base unit are configured to communicate with one another over a communication link,
     - the target unit is further configured to (a) detect projectile hits on the target and (b) communicate data relating to the projectile hits to the base unit via the communication link, and
     - the base unit is further configured to communicate commands for controlling the target unit to the target unit via the communication link.

2. The target shooting system of example 1, wherein the communication link includes a two-way wireless communication link.

3. The target shooting system of example 1 or example 2, wherein the communication link utilizes LoRa radio technology.

4. The target shooting system of any of examples 1-3, wherein the data relating to the projectile hits on the target includes a timestamp indicating a time a projectile hit the target.

5. The target shooting system of any of examples 1-4, wherein:
   - the target unit includes a global positioning system (GPS) receiver; and
   - the target unit is further configured to (a) determine the first location using the GPS receiver and (b) communicate the first location to the base unit via the communication link.

6. The target shooting system of any of examples 1-5, wherein the target unit is further configured to (a) capture a temperature, barometric pressure, or altitude measurement corresponding to the first location, and (b) communicate the temperature, barometric pressure, or altitude measurement to the base unit via the communication link.

7. The target shooting system of any of examples 1-6, wherein at least a portion of the target unit is configured to be mounted on the target.

8. The target shooting system of example 7, wherein:
   - at least the portion of the target unit includes one or more visual indicators; and at least the portion of the target unit is configured to be mounted on a backside of the target such that the one or more visual indicators are visible when viewing a frontside of the target opposite the backside.

9. The target shooting system of any of examples 1-8, wherein the target unit includes one or more visual indicators configured to visually convey information to a third location different from the first location.

10. The target shooting system of example 8 or example 9, wherein the commands for controlling the target unit include commands for controlling the one or more visual indicators.

11. The target shooting system of any of examples 1-10, wherein the target unit includes a speaker configured to audibly convey information to a third location different from the first location.

12. The target shooting system of example 11, wherein the commands for controlling the target unit include commands for controlling the speaker.

13. The target shooting system of any of examples 1-12, wherein the second location is at or near a shooting location of a user.

14. The target shooting system of any of examples 1-13, wherein the base unit is configured to determine a timing a projectile is shot from a shooting location toward the target.

15. The target shooting system of any of examples 1-14, wherein:

the base unit includes a global positioning system (GPS) receiver; and the base unit is further configured to determine the second location using the GPS receiver.

16. The target shooting system of any of examples 1-15, wherein:

the target unit is a first target unit and the target is a first target;

the target shooting system further includes a second target unit deployable at a third location at or near a location of a second target;

the third location is different from the first location and the second location;

the second target unit and the base unit are configured to communicate with one another over the communication link;

the second target unit is further configured to (a) detect projectile hits on the second target and (b) communicate data relating to the projectile hits on the second target to the base unit via the communication link, and the base unit is further configured to communicate commands for controlling the second target unit to the second target unit via the communication link.

17. The target shooting system of example 16, wherein the first target unit and the second target unit are configured to communicate with one another over the communication link.

18. The target shooting system of any of examples 1-17, wherein:

the communication link is a first communication link; and the base unit is further configured to communicate with a software application on a user device over a second communication link different from the first communication link.

19. The target shooting system of example 18, wherein the second communication link utilizes Bluetooth communication protocols, WiFi communication protocols, or cellular communication protocols.

20. The target shooting system of example 18 or example 19, wherein the commands for controlling the target unit include commands issued by the software application for proactively controlling the target unit prior to a user shooting a projectile toward the target.

21. The target shooting system of any of examples 17-20, wherein the commands for controlling the target unit include commands issued by the software application for reactively controlling the target unit based at least in part on the target unit detecting that the target was hit by a projectile.

22. A method of operating a target shooting system via a software application running on a user device, the method comprising:

issuing a command for controlling a target unit deployed at a first location at or near a target, wherein issuing the command includes communicating, via a communication link, the command to a base unit deployed at a second location different from the first location; and receiving, from the base unit, data related to a projectile shot at the target.

23 The method of example 22, wherein the command for controlling the target unit includes a command instructing the target unit to (i) emit light from a visual indicator of the target unit or (ii) emit sound from a speaker of the target unit.

24. The method of example 23, wherein issuing the command includes issuing the command prior to receiving the data related to the projectile shot at the target.

25. The method of example 23, wherein issuing the command includes issuing the command based at least in part on receiving the data related to the projectile shot at the target.

26. The method of any of examples 22-25, wherein receiving the data related to the projectile shot at the target includes receiving an indication of a time that the projectile was shot at the target.

27. The method of any of examples 22-26, further comprising detecting a timing that the projectile was shot at the target.

28. The method of any of examples 22-27, wherein receiving the data related to the projectile shot at the target includes receiving an indication of a time that the projectile hit the target.

29. The method of any of examples 22-28, further comprising receiving, from the base unit, an indication of the first location.

30. The method of any of examples 22-29, further comprising receiving, from the base unit, an indication of the second location.

31. The method of any of examples 22-30, further comprising determining a distance between the first location and a third location from which the projectile is shot at the target.

32 The method of any of examples 22-31, further comprising calculating, based at least in part on the data related to the projectile shot at the target, a projectile velocity corresponding to the projectile, a time of flight corresponding to the projectile, a drag function corresponding to the projectile, a deceleration value corresponding to the projectile, and/or a ballistic coefficient corresponding to the projectile.

33. The method of any of examples 22-32, further comprising calculating, based at least in part on the data related to the projectile shot at the target, a reaction time of a shooter.

34 The method of any of examples 22-33, wherein the communication link utilizes Bluetooth communication protocols, WiFi communication protocols, or cellular communication protocols.

35. The method of any of examples 22-34, wherein:

the communication link is a first communication link; and the method further comprises communicating, via a second communication link, at least a subset of the data related to the projectile shot at the target to a remote server or database.

36. The method of any of examples 22-35, wherein:

the communication link is a first communication link; and the method further comprises communicating, via a second communication link, at least a subset of the data related to the projectile shot at the target to a hearing protection device.

37. The method of any of examples 22-36, further comprising receiving, from the base unit, a measurement corresponding to the first location or to the second location, wherein the measurement includes a temperature measurement, a barometric pressure measurement, or an altitude measurement.

38 The method of any of examples 22-37, wherein:

the target is a first target and the projectile is a first projectile; and the method further comprises receiving, from the base unit, data related to a second projectile shot at a second target different from the first target.

39 The method of example 38, wherein:

the target unit is a first target unit and the command is a first command;

the method further comprises issuing a second command for controlling a second target unit deployed at a third location at or near the second target;

the third location is different from the first location and the second location; and issuing the second command includes communicating, via the communication link, the second command to the base unit deployed at the second location.

40 The method of example 39, wherein the second command is the first command and/or is transmitted at a same timing as the first command.

41. The method of example 39, wherein the second command is different from the first command and/or is transmitted at a different timing from the first command.

42. The method of any of examples 22-41, wherein the data related to a projectile shot at the target includes data indicating that the projectile missed the target.

43. The method of any of examples 22-42, further comprising determining that the projectile shot at the target missed the target.

44 The method of any of examples 22-43, wherein the data related to the projectile shot at the target includes data indicating a distance between (a) a first location on the target at which the projectile hit the target and (b) a second location on the target.

45 The method of any of examples 22-44, wherein:

the command is a first command, the projectile is a first projectile, and the data related to the first projectile is first data corresponding to a first user; and the method further comprises— issuing a second command for controlling the target unit, wherein issuing the second command includes communicating, via the communication link, the second command to the base unit; and receiving, from the base unit, second data related to a second projectile shot at the target, wherein the second data corresponds to a second user different from the first user.

46. The method of any of examples 22-45, wherein:

the command is a first command, the target unit is a first target unit, the target is a first target, the projectile is a first projectile, and the data related to the first projectile is first data corresponding to a first user; and the method further comprises— issuing a second command for controlling a second target unit deployed at a third location at or near a second target, wherein the third location is different from the first location, and wherein issuing the second command includes communicating, via the communication link, the second command to the base unit; and receiving, from the base unit, second data related to a second projectile shot at the second target, wherein the second data corresponds to a second user different from the first user.

47. The method of example 45 or example 46, further comprising scoring or ranking the first user and the second user based at least in part on the first data and the second data.

48. The method of any of examples 22-47, wherein:

the target is a first target, the projectile is a first projectile, and the data related to the first projectile is first data corresponding to a first user;

the method further comprises receiving second data related to a second projectile shot at a second target; and the second data corresponds to a second user different from the first user.

49 The method of example 48, wherein receiving the second data includes receiving the second data via a server or database remote from the user device.

50. The method of example 47 or example 48, further comprising scoring or ranking the first user and the second user based at least in part on the first data and the second data.

51. A target shooting system, comprising:

a base unit;

a plurality of target units, each target unit associated with a respective target and configured to detect projectile hits on the respective target;

a communication network facilitating communication between the base unit and the plurality of target units; and a user device running a software application configured to communicate with the base unit, wherein the software application is operable to control the plurality of target units via the base unit and the communication network.

52. A target unit for a target shooting system, the target unit comprising:

a housing attachable to a target;

a sensor configured to detect projectile hits on the target;

a communication module configured to communicate with a base unit via a wireless network;

one or more visual indicators; and a processor configured to control the one or more visual indicators based on commands received from the base unit via the communication module.

53. The target unit of example 52, further comprising a global positioning system (GPS) receiver, wherein the target unit is configured to (a) determine a location of the target unit using the GPS receiver and (b) communicate the location to the base unit via the wireless network.

54 The target unit of example 52 or example 53, wherein the processor is configured to determine timings of the projectile hits on the target.

55. The target unit of any of examples 52-54, wherein the sensor includes an optical sensor configured to determine a location of projectile hits relative to a reference point on the target.

56. The target unit of any of examples 52-55, wherein the sensor is configured to detect vibrations cause by projectile hits on the target.

57. The target unit of any of examples 52-56, wherein the processor is configured to control a color, a sequence, and/or a frequency of light emitted by the one or more visual indicators based at least in part on (a) the commands received from the base unit, (b) the sensor detecting a projectile hit on the target, or (c) a combination thereof.

58. A base unit for a target shooting system, the base unit comprising:

a transceiver configured to communicate with a target unit over a communication link, the target unit being deployable at or near a location of a target;

a processor coupled to the transceiver and configured to:

receive, via the transceiver, data relating to projectile hits on the target detected by the target unit;

generate commands for controlling a visual indicator of the target unit; and transmit, via the transceiver, the commands to the target unit over the communication link.

59 The base unit of example 58, further comprising a sensor configured to detect when a projectile is fired from a shooting location, wherein the processor is further configured to record a timing of when the projectile is fired.

D. CONCLUSION

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order above, alternative embodiments may perform steps in a different order. Furthermore, the various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. To the extent any material incorporated herein by reference conflicts with the present disclosure, the present disclosure controls.

Where the context permits, singular or plural terms may also include the plural or singular term, respectively. In addition, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Furthermore, as used herein, the phrase "and/or" as in "A and/or B" refers to A alone, B alone, and both A and B. Additionally, the terms "comprising," "including," "having," and "with" are used throughout to mean including at least the recited feature(s) such that any greater number of the same features and/or additional types of other features are not precluded. Moreover, as used herein, the phrases "based on," "depends on," "as a result of," and "in response to" shall not be construed as a reference to a closed set of conditions. For example, an exemplary step that is described as "based on condition A" may be based on both condition A and condition B without departing from the scope of the present disclosure. In other words, as used herein, the phrase "based on" shall be construed in the same manner as the phrase "based at least in part on" or the phrase "based at least partially on."

From the foregoing, it will also be appreciated that various modifications may be made without deviating from the disclosure or the technology. For example, one of ordinary skill in the art will understand that various components of the technology can be further divided into subcomponents, or that various components and functions of the technology may be combined and integrated. In addition, certain aspects of the technology described in the context of particular embodiments may also be combined or eliminated in other embodiments. Furthermore, although advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A target shooting system, comprising:

a target unit deployable at a first location at or near a location of a target; and a base unit deployable at a second location different from the first location, wherein:

the target unit and the base unit are configured to communicate with one another over a communication link;

the target unit is further configured to detect projectile hits on the target and communicate data relating to the projectile hits to the base unit via the communication link;

the base unit is further configured to communicate, to the target unit and via the communication link, commands for controlling the target unit;

the communication link is a first communication link;

the base unit is further configured to communicate with a software application on a user device over a second communication link different from the first communication link to receive information input by a user to the software application;

the information includes a type of a shooting device used to shoot a projectile at the target;

at least one of a shot detection score, a target miss score, or a shooter reaction time score of the user is based on the type of the shooting device; and the information includes an identification of a shooting lane in which the target is positioned and the at least one of the shot detection score, the target miss score, or the shooter reaction time score of the user is based on the identification of the shooting lane.

2. The target shooting system of claim 1, wherein the data relating to the projectile hits on the target includes a timestamp indicating a time a projectile hit the target.

3. The target shooting system of claim 1, wherein:

the target unit includes a global positioning system (GPS) receiver; and the target unit is further configured to (a) determine the first location using the GPS receiver and (b) communicate the first location to the base unit via the communication link.

4. The target shooting system of claim 1, wherein the target unit is further configured to (a) capture a temperature, barometric pressure, or altitude measurement corresponding to the first location, and (b) communicate the temperature, barometric pressure, or altitude measurement to the base unit via the communication link.

5. The target shooting system of claim 1, wherein:

the target unit includes one or more visual indicators that are visible when viewing a frontside of the target; and at least a portion of the target unit is configured to be mounted on a backside of the target, opposite the frontside.

6. The target shooting system of claim 1, wherein:

the target unit includes a speaker configured to audibly convey information; and the commands are configured to instruct the speaker to audibly convey information according to a first property prior to a user shooting a projectile toward the target, and to audibly convey information according to a second property, different than the first property, in response to detecting that the target was hit with a projectile.

7. The target shooting system of claim 1, wherein the base unit is configured to determine a timing a projectile is shot from a shooting location toward the target.

8. The target shooting system of claim 1, wherein:

the base unit includes a global positioning system (GPS) receiver; and the base unit is further configured to determine the second location using the GPS receiver.

9. The target shooting system of claim 1, wherein:

the target unit is a first target unit and the target is a first target;

the target shooting system further includes a second target unit deployable at a third location at or near a location of a second target;

the third location is different from the first location and the second location;

the second target unit and the base unit are configured to communicate with one another over the communication link;

the second target unit is further configured to (a) detect projectile hits on the second target and (b) communicate data relating to the projectile hits on the second target to the base unit via the communication link; and the base unit is further configured to communicate commands for controlling the second target unit to the second target unit via the communication link.

10. The target shooting system of claim 9, wherein the first target unit and the second target unit are configured to communicate with one another over the communication link.

11. The target shooting system of claim 1, wherein the second communication link utilizes at least one of a Bluetooth communication protocol, a Wi-Fi communication protocol or a cellular communication protocol.

12. The target shooting system of claim 1, wherein the commands for controlling the target unit include commands issued by the software application for proactively controlling the target unit prior to a user shooting a projectile toward the target.

13. The target shooting system of claim 1, wherein the commands for controlling the target unit include commands issued by the software application for reactively controlling the target unit based at least in part on the target unit detecting that the target was hit by a projectile.

14. The target shooting system of claim 1, wherein the base unit comprises:

one or more transceivers configured to communicate with the target unit and the user device over the respective communication links; and a processor coupled to the one or more transceivers and configured to receive, via the one or more transceivers, data relating to the projectile hits and data identifying the type of the shooting device.

15. The target shooting system of claim 14, further comprising a sensor configured to detect when a projectile is fired from a shooting location, wherein the processor is further configured to record a timing of when the projectile is fired.

16. The base unit of claim 14, wherein the processor is configured to receive the data identifying the type of the shooting device from a software application on a user device.

17. The target shooting system of claim 1, wherein the information includes a position of the target relative to the shooting location and the at least one of the shot detection score, the target miss score, or the shooter reaction time score of the user is based on the position.

18. The target shooting system of claim 1, wherein the information includes a position of the target relative to at least one of the target unit or the base unit and the at least one of the shot detection score, the target miss score, or the shooter reaction time score of the user is based on the position.

19. A target shooting system, comprising:

a target unit deployable at a first location at or near a location of a target; and a base unit deployable at a second location different from the first location, wherein:

the target unit and the base unit are configured to communicate with one another over a communication link;

the target unit is further configured to detect projectile hits on the target and communicate data relating to the projectile hits to the base unit via the communication link;

the base unit is further configured to communicate, to the target unit and via the communication link, commands for controlling the target unit;

the communication link is a first communication link;

the base unit is further configured to communicate with a software application on a user device over a second communication link different from the first communication link to receive information input by a user to the software application;

the information includes an identification of a shooting lane in which the target is positioned; and the identification of a shooting lane is to inform an algorithm employed by at least one of the target unit, the software application or the base unit.

20. The target shooting system of claim 19, wherein the algorithm comprises at least one of a shot detection algorithm, a target miss algorithm, or a shooter reaction time algorithm.

* * * * *